US006948289B2

(12) United States Patent
Bravinski

(10) Patent No.: US 6,948,289 B2
(45) Date of Patent: Sep. 27, 2005

(54) METHOD AND MEANS FOR PREFABRICATION OF 3D CONSTRUCTION FORMS

(76) Inventor: Leonid Bravinski, 1401 NW 2nd Street, Toronto, Ontario (CA), L4K 4Y2

( * ) Notice: Subject to any disclaimer, the term of this patent is extended or adjusted under 35 U.S.C. 154(b) by 30 days.

(21) Appl. No.: 10/253,843

(22) Filed: Sep. 24, 2002

(65) Prior Publication Data

US 2004/0055237 A1 Mar. 25, 2004

(51) Int. Cl.[7] ..... E04B 2/00

(52) U.S. Cl. ..... 52/415; 52/416; 52/418; 52/419; 52/424; 52/426; 52/428; 52/658; 52/309.1; 52/309.7; 249/187.1; 249/188; 249/189; 249/190; 249/191; 249/192; 249/193; 249/194

(58) Field of Search ..... 52/309.1, 309.2, 52/309.4, 309.7, 309.11, 309.12, 415, 6, 418, 419, 424, 426, 658, 317, 428; 249/187.1, 188, 189, 190–193, 194

(56) References Cited

U.S. PATENT DOCUMENTS

| | | | | | |
|---|---|---|---|---|---|
| 1,617,033 | A | * | 2/1927 | Shields | 52/423 |
| 2,921,462 | A | * | 1/1960 | Wilson | 52/223.13 |
| 3,805,649 | A | * | 4/1974 | Hester | 83/177 |
| 4,063,065 | A | | 12/1977 | Wust | |
| 4,326,909 | A | | 4/1982 | Slavik | |
| 4,393,635 | A | * | 7/1983 | Long | 52/309.11 |
| 4,552,600 | A | | 11/1985 | Laiewski et al. | |
| 4,747,895 | A | * | 5/1988 | Wallerstein et al. | 156/73.3 |
| 4,805,366 | A | * | 2/1989 | Long | 52/309.11 |
| 4,967,528 | A | * | 11/1990 | Doran | 52/309.12 |
| 5,323,578 | A | * | 6/1994 | Chagnon et al. | 52/426 |
| 5,350,162 | A | | 9/1994 | Cushing | |
| 5,658,483 | A | | 8/1997 | Boeshart | |
| 5,771,648 | A | * | 6/1998 | Miller et al. | 52/309.7 |
| 5,809,725 | A | * | 9/1998 | Cretti | 52/426 |
| 5,857,293 | A | * | 1/1999 | Redjvani | 52/63 |
| 5,887,401 | A | | 3/1999 | Moore, Jr. | |
| 6,263,638 | B1 | * | 7/2001 | Long, Sr. | 52/794.1 |
| 6,318,040 | B1 | | 11/2001 | Moore, Jr. | |
| 6,321,498 | B1 | * | 11/2001 | Trovato | 52/426 |
| 6,360,505 | B1 | * | 3/2002 | Johns | 52/311.1 |
| 6,405,505 | B1 | * | 6/2002 | Alberti | 52/562 |
| 6,612,083 | B1 | * | 9/2003 | Richards | 52/309.11 |
| 2001/0020351 | A1 | | 9/2001 | Alvaro | |

* cited by examiner

*Primary Examiner*—Jeanette E. Chapman
(74) *Attorney, Agent, or Firm*—McKee, Voorhees & Sease, P.L.C.

(57) ABSTRACT

The invention involves a manner of fabricating 3D construction forms by preparing first and second standard sized panels with a predetermined pattern of perforations and assembling same in spaced apart relationship by connecting the panels together with connectors designed to engage the perforations in the panels. The perforations of the panels are arranged in a specific pattern suitable for the assembly and use of the construction forms by means of an apparatus designed to form the perforations. The method also uses apparatus which assist in the orientation and alignment of the connectors to engage the panels. Modifications of the panels and connectors will allow the formation of 3D construction forms with corners of various configuration.

29 Claims, 23 Drawing Sheets

54
50
24
56
57

53 CUTTING LINE
52 WELDING
54
24
54
5c
5d
5c 53
56
57
1-1
56
54

24
56
57
56
2 - 2
54
5d 56
24
54
32
42

57
30
30
42

METHOD AND MEANS FOR PREFABRICATION OF 3D CONSTRUCTION FORMS

This invention relates to the field of construction. In particular, it relates to means and methods for prefabrication of 3D construction forms used for reinforcement positioning, forming and insulation of reinforced concrete walls, concrete walls and other structural elements of poured concrete.

The invention is particularly useful for construction in which insulation material is used as concrete forms, which remain in place after concrete hardening to provide wall insulation, as well.

While modern concrete construction, with or without reinforcing, frequently employs reusable forms of flat elements, there is a growing tendency towards the employment of prefabricated 3D construction forms, which remain in place after concrete hardening and remain part of the final building structure. This is especially true where the wall is required to be thermally insulated.

Said prefabricated 3D construction forms are formed with spacing of two panels or slabs from light weighted and thermal insulating materials, such as expanded and extruded polystyrene.

Various techniques for prefabrication of 3D construction forms have been developed. The opposite panels of prefabricated 3D construction forms are held together in spaced relationship by some manner of cross-bracing, mounted to insulation panels with fasteners. These prefabricated 3D construction forms may then be delivered and placed into the designed position of the wall to be poured full of premixed concrete which is allowed to harden in place.

This provides a strong wall, with or without reinforcing, and has the advantage of insulation on two surfaces.

Currently, there are known methods of prefabrication of 3D construction forms used in construction industry, which are made from expanded polystyrene. Prefabricated 3D construction forms are formed when transverse elements or fasteners are pre-installed.

These methods require special expensive machines and molds to produce the 3D construction forms, which lead to the high cost of the 3D construction forms, and consequently the cost of building in general.

Also, there are other known methods for prefabrication of the 3D construction forms provided by flat panels from expanded or extruded polystyrene, the bodies of said panels having cut-outs or openings. With this, 3D construction forms are formed by installation of cross-bracing with fasteners into the openings and fixation ones to said flat panels.

Examples of prior art methods for prefabrication of 3D construction forms are disclosed in U.S. Pat. Nos. 5,771,648 and 5,809,725 where transverse connectors are joined with fasteners at the moment of fixation to polystyrene panels through openings in the said panels.

However, all of these prior art methods have certain disadvantages which are sought to be overcome by the present invention.

It should be noted, that known methods of the openings perforation, such as milling and so on, are not effective for openings perforation from foam plastic due to its low strength. Besides, openings perforation with mechanical impact on foam plastic is very complicated to control because of coarse structure of foam polystyrene.

U.S. Pat. No. 4,552,600 issued to Stanislaus J. Laewski et al. on Nov. 12, 1985 discloses a method and a design for fabrication of the perforated item from plastic. This method and design are preferable at a synchronized fabrication and perforation of the item. Besides, application of the solid heated pins as perforation instrument does not provide the required geometry of the openings in the foam plastic panels at balanced proportion of the panel thickness to the width and height, because thermal field of this pin will be rather different along its length.

Said equipment cannot be used for implementation of the present invention and its aim is to design equipment for perforation of panels from polystyrene with standard sizes for prefabrication of the 3D construction forms.

The present invention has another goal, which is improvement of the method for prefabrication of 3D construction forms from standard polystyrene panels 4'×8', standard transverse elements and standard connectors.

It is one purpose of this invention to provide poured concrete forms which may be fabricated from available standard size, and insulating panels which may additionally be cut to provide forms of modified dimensions.

Also, the present invention offers a method for prefabrication of the 3D construction forms with non-standard height from the panels of standard size, standard transverse elements and standard connectors.

U.S. Pat. No. 5,887,401 issued to James Moore on Mar. 30, 1999 discloses a method of production of the 3D construction forms of the wall corner element. Parallel panels are connected with a special horizontal mesh comprises bent longitudinal re-bars. Fabrication of said 3D construction forms requires a special forming equipment and a variety of forms for the 3D construction forms fabrication. Besides, the horizontal meshes with re-bars for the 3D construction forms must be fabricated separately, which as a rule increases the 3D construction forms system's price in general.

The present invention will improve a method of prefabrication of the 3D construction corner form which use only panels with standard size, as well as with transverse elements, which are standard for said construction forms.

Also, the goal of the present invention is offering methods when said prefabricated 3D construction forms can have different sizes and adapted to create another corners for reservoirs, radial walls and so on.

U.S. Pat. No. 5,350,162 issued to Meredith K. Cushing on Sep. 27, 1994 discloses an apparatus for assembling transverse elements of the spatial structure into spatial cage. This is provided with retaining the transverse elements by details of such apparatus at pre-determined spacing and consequent elements fixation with the longitudinal elements. However, application of this apparatus and method for the prefabrication of the 3D construction form is labor consuming and causes additional assembly operations and additional device for fixation of the 3D construction forms panels to the spatial cage.

None of the above mentioned patents discloses the method of module production comprising two parallel panels connected with connectors and reinforcing webbing offered in the present invention.

Such method of production of the 3D construction forms enables to fabricate 3D construction forms both on the plant environment and on the construction site, what allows quick erection of the reinforced concrete walls at minimum labor costs and expenses.

None of the above patents, either separately or in combination with one another cites the description of the innovations similar to these ones claimed in the present invention.

These foregoing objects and other advantages are sought to be achieved by means of the present invention in which a method of fabricating 3D construction forms comprise the steps of preparing a first rigid panel with a predetermined pattern of perforations, preparing a second standard sized panel with a similar predetermined pattern of perforations, assembling the first and second panels in a fixed parallel spaced relationship by connecting the panels together with connectors designed to engage the perforations of the respective panels. Ideally, the panels are made of standard sized insulating polystyrene and the connectors comprise transverse rods extending between the panels and tie rods extending between the transverse rods to maintain the spacing between the tie rods corresponding to the pattern of perforation and fasteners are provided to maintain the panels engaged to the transverse rods.

The dimensions of the forms may be extended by adding portions of a standard panel in edge to edge relationship so as to form a non-standard size dimension.

The method of the present invention is achieved by apparatus designed to form a predetermined pattern of perforations on the panels, the apparatus including a carriage mounted on tracks to travel on the first direction and a frame adapted to hold the panels and mounted to move on the carriage in a second direction perpendicular to the first direction, and means mounted above the panel to move a perforating means, consisting of a longitudinal tubular probe heated by an electrical resistance coil into contact with the panel and to cause perforations therethrough.

The method also involves apparatus for assembly which includes a stand and a frame mounted to support a first panel and a series of clamps adapted to hold a plurality of connectors in a fixed position oriented and aligned to engage the perforations of the panels.

Further embodiments of the invention involve a method of fabricating 3D constructions forms in a manner to create corners by cutting panels into appropriate sizes and modifying the connectors to connect the inner and outer panels in a manner which forms a corner of 90° or other shape.

In one aspect of the invention, there is provided a method of fabricating a 3D construction form comprising the steps of: a) providing a panel with a thickness, said panel having a plurality of transverse axially oriented perforations through said thickness and being arranged in a predetermined pattern, said panel being oriented in a generally longitudinal orientation; b) holding a plurality of connectors in a generally fixed transverse orientation, said connectors having an end portion that is generally axially aligned with said axial orientation of said perforations; c) moving one or both of said panel and said plurality of transverse connectors towards the other or each other such that an end portion of each of said connectors is received axially at substantially the same time, into one said plurality of perforations; d) affixing a fastener proximate said end portion of each of said connectors to fix each of said connectors to said panel.

According to another aspect of the invention, there is provided a method of fabricating a 3D construction form comprising the steps of: a) providing a first panel with a thickness, said first panel having a plurality of transverse axially oriented perforations through said thickness and being arranged in a pre-determined pattern, said panel being oriented in a generally longitudinal orientation and having a length of a first distance; b) holding a plurality of connectors in a generally fixed transverse orientation, each of said plurality of connectors having an end portion that is generally axially aligned with said axial orientation of said perforations, said plurality of connectors extending longitudinally a second distance that is greater than said first distance; c) moving one or both of said first panel and a first act of connectors of said plurality of transverse connectors towards the other or each other such that an end portion of each of said first set of connectors is received axially at substantially the same time, into one said plurality of perforations of said first panel; d) affixing a fastener proximate said end portion of each of said first set of connectors to fix each of said first set of connectors to said first panel; e) providing a second panel with a thickness, said second panel having a second plurality of transverse axially oriented perforations through said thickness and being arranged in a pre-determined pattern, said second panel being oriented in a generally longitudinal orientation and generally in longitudinal alignment with said first panel, said second panel having a length of a third distance; f) moving one or both of said second panel and a second set of connectors of said plurality of connectors towards the other or each other such that an end portion of each of said second set of connectors is received axially at substantially the same time, into one said plurality of perforations of said second panel; and g) affixing a fastener proximate said end portion of each of said second set of connectors to fix each of said second set of connectors to said second panel.

According to another aspect of the invention, there is provided a method of forming perforations in a panel of thermoplastic material comprising the steps of a) providing an elongated tube that emits radiant heat to create a thermal field around a portion of said tube sufficient to raise the temperature of said material at a location sufficient to melt said material at said location without said tube touching said material; b) advancing said tube and its associated thermal field toward said thermoplastic material at a rate so as to melt said material without said portion touching said material until said material is perforated therethrogh; c) withdrawing said tube.

According to yet another aspect of the invention, there is provided a method of fabricating a construction form comprising the steps of: a) providing a first panel with a thickness, said first panel having a plurality of generally transverse axially oriented perforations through said thickness, said panel being oriented in a generally longitudinal orientation and said panel being made from a re-shapeable material; b) providing a plurality of connectors, each of said connectors having an end portion that is generally axially aligned with said axial orientation of said perforations; c) providing a stopper mechanism at an inner surface o said first panel; d) providing a fastener for each of said plurality of connectors, each of said fasteners having a outer surface profile which is enlarges from an inner end toward a outer end; e) engaging each said fastener with said end portion of each of said plurality of connectors through a perforation of said plurality of perforations to mount each of said connectors to said first panel; wherein said fasteners are adapted to be tightened on said connector such that said panel is compressed between said stopper mechanism and at least a portion of said fastener, and said profile of said fastener deforms said panel proximate to block said perforations.

According to yet another aspect of the invention, there is provided a method of fabricating a construction form comprising the steps of: a) providing a first panel with a thickness, said first panel having at least generally transverse axially oriented perforations trough said thickness, said panel being oriented in a generally longitudinal orientation and said panel being made from a suitable re-shapeable material; b) providing a connectors that is generally axially aligned with said axial orientation of said perforation; c) providing a stopper mechanism at an inner surface of said first panel; d) providing a fastener at an end portion of said connector, said fastener having an outer surface profile which generally enlarges from an inner end toward a outer end; e) engaging said fastener with said end portion of said connector through said perforation to mount said connector to said first panel; wherein said fastener is adapted to be tightened on said connector such that said panel is compressed between said stopper mechanism and at least a portion of said fastener, and said profile of said fastener reshapes said panel to block said perforations.

The nature of the present invention may be better understood by a detailed description of the preferred embodiments thereof with reference to the following drawings in which.

Figure 3C:
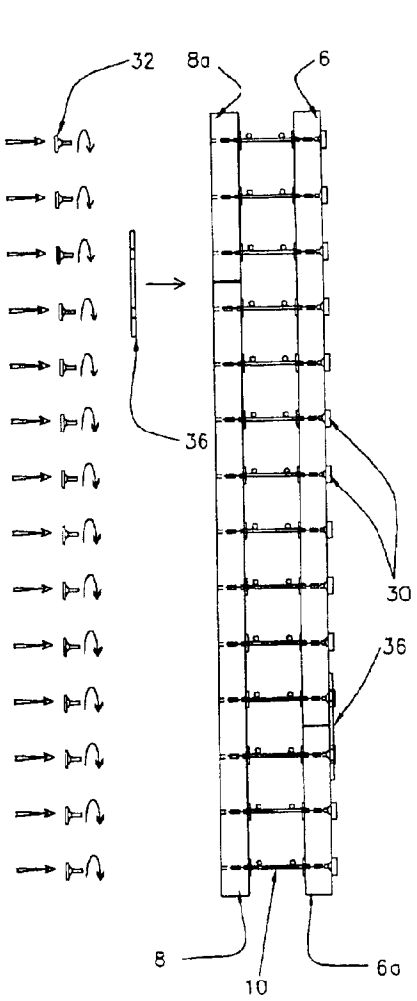
Figure 3B:
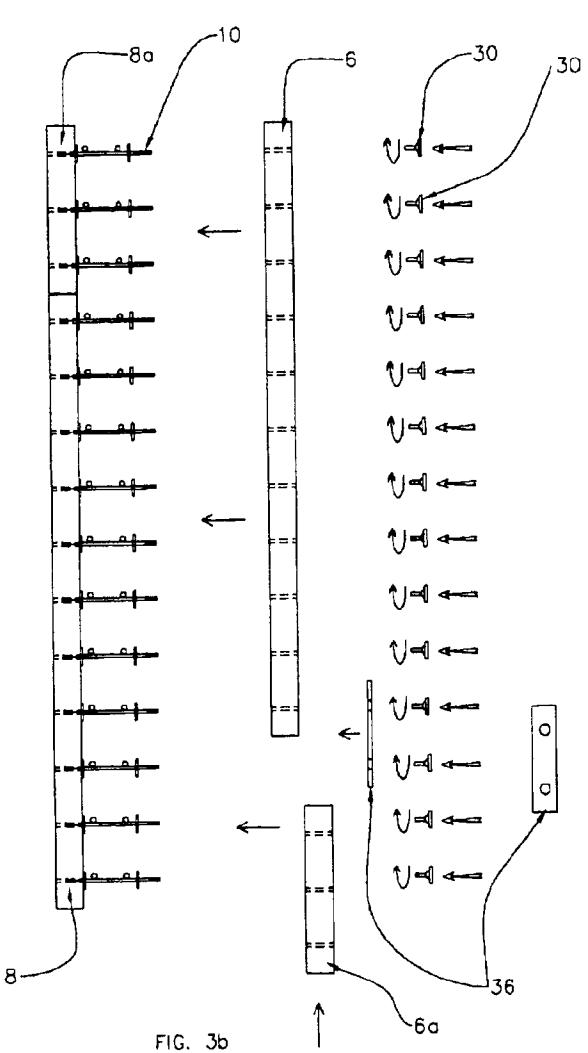
Figure 3C:
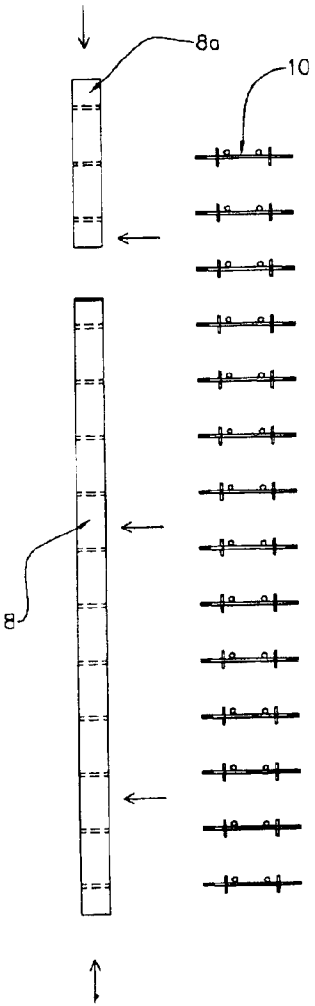
Figure 4:
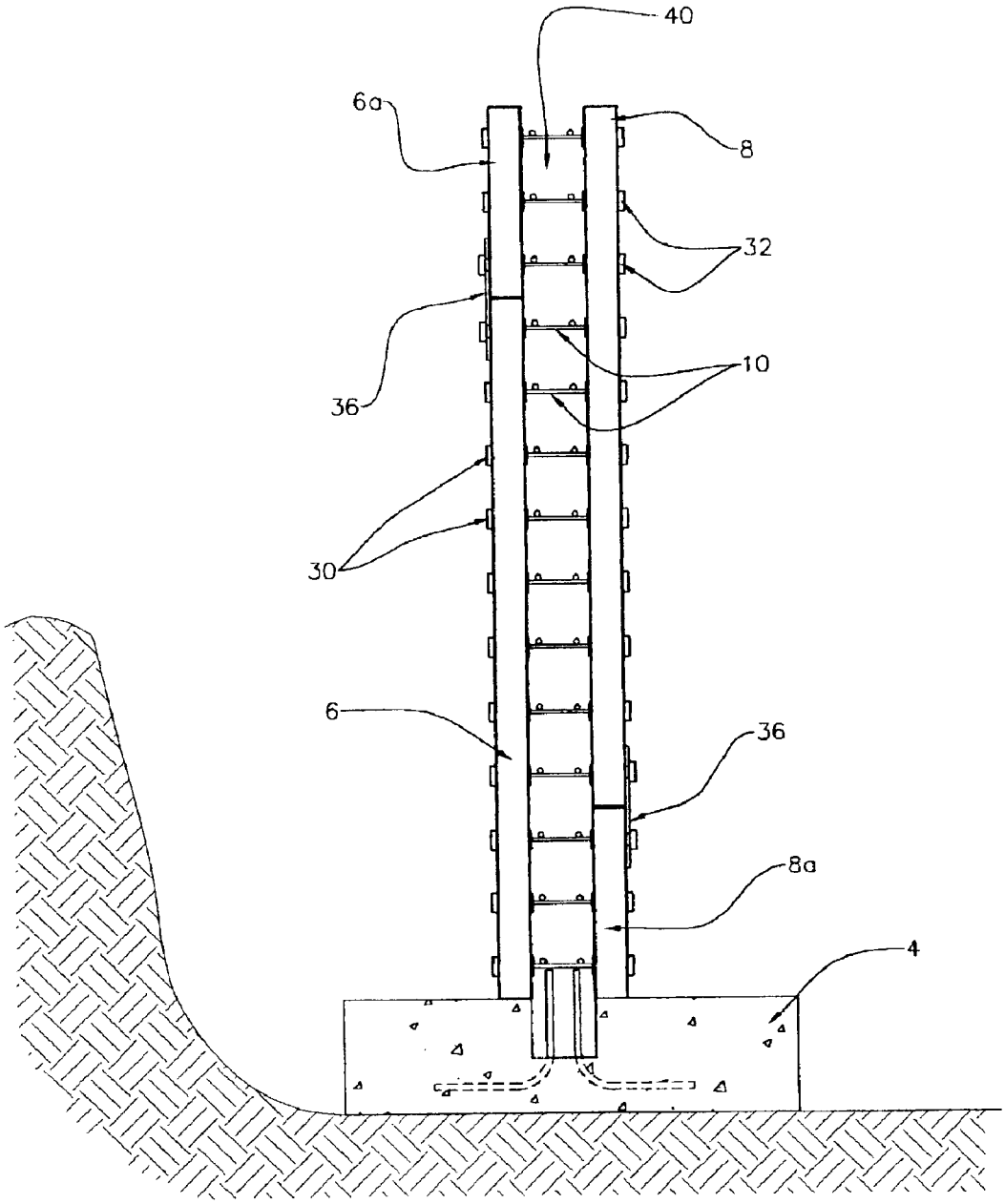
Figures 5, 5A, 5B, 5C, 5D, 5E:
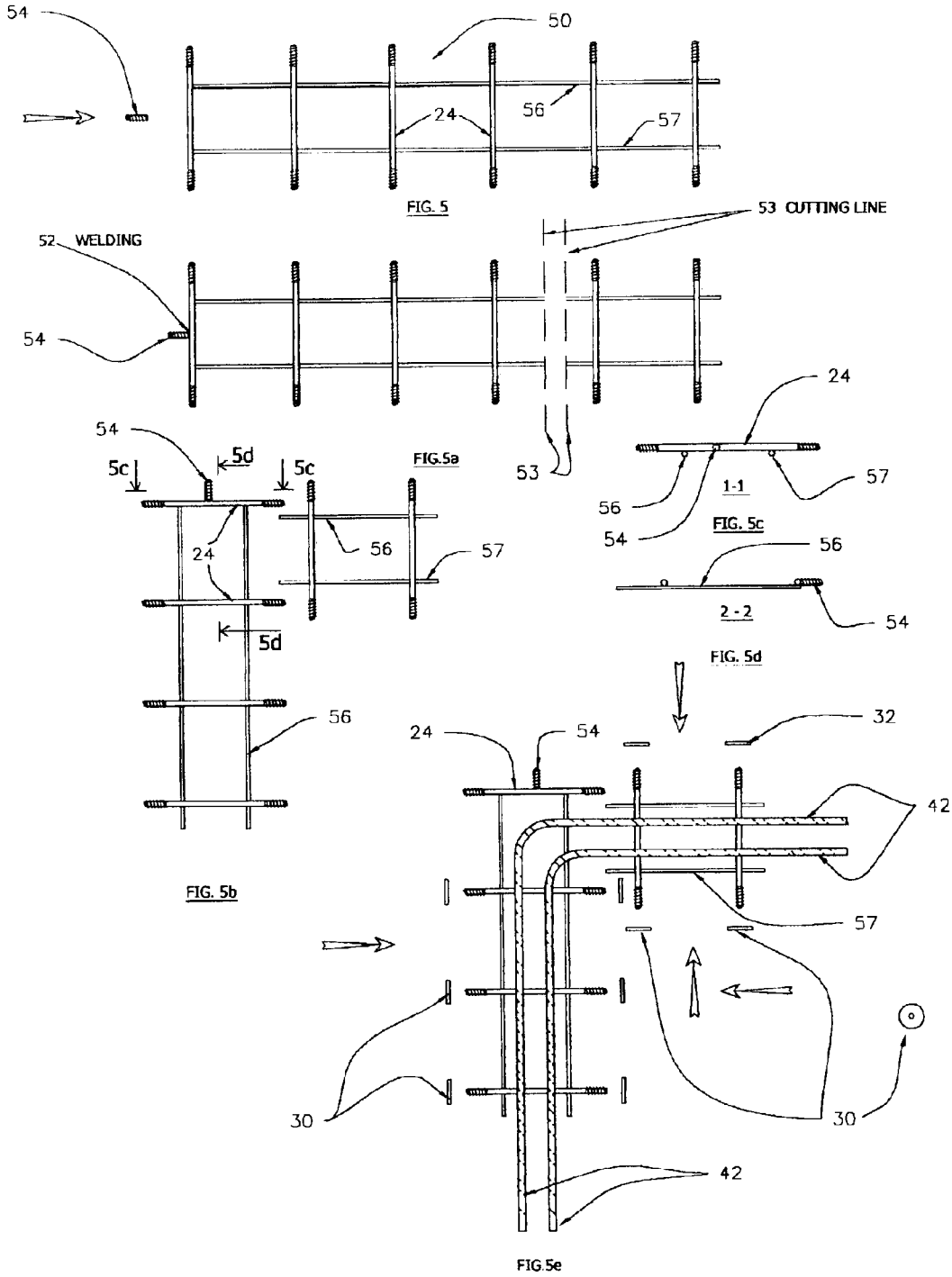

FIGS. 3*a*, 3*b*, 3*c* are side elevation views showing the assembly sequence of a section of 3D construction forms of modified dimensions, which made of standard components used for 3D construction forms of standard dimensions;

FIG. 4 is an elevation view of an assembled prefabricated 3D construction form of modified dimensions resting on a footing;

FIGS. 5, 5*a*, 5*b*, 5*c*, 5*d*, 5*e*, 5*f*, 5*g*, 5*h*, 5*i*, 5*j*, 5*k*, 5*l*, 5*m*, 5*n* ilustrate the technological operations for prefabricating 3D construction form used for reinforcing, forming and insulating the corners of the reinforced concrete walls and other structural elements, the components of which are made from panels, fasteners and connectors of the 3D construction form of the standard size;

FIG. 5 is a plan view of standard design of connectors without stoppers installed and used in standard prefabricated 3D construction form shown in FIGS. 2*a*, 2*b*, 2*c*, 2*d*. Direction of installation additional connecting detail with fastener is shown in arrow;

FIG. 5*a* shows a means of modifying the connectors in FIG. 5 to form a connector for prefabricated 3D construction corner form;

FIG. 5*b* shows the arrangement of the modified sections of connectors in FIG. 5*a* to form a connector for prefabricated 3D construction corner form;

FIGS. 5*c* and 5*d* are vertical cross-sections of the sections of connector corners in FIG. 5*b;*

Figure 5F:
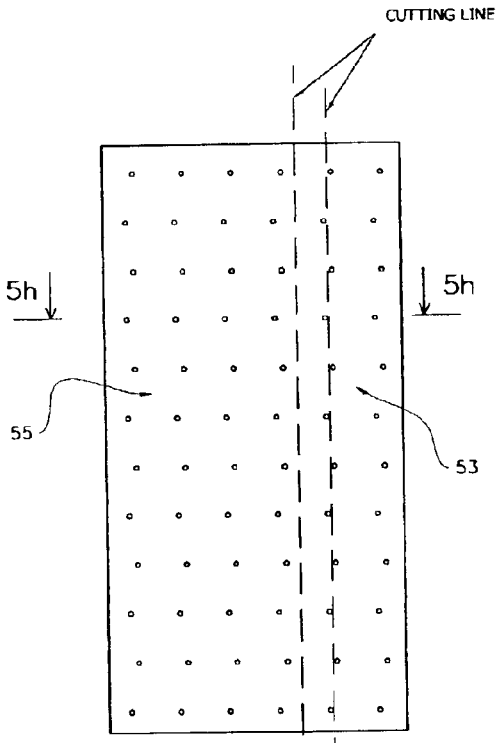
Figure 5G:
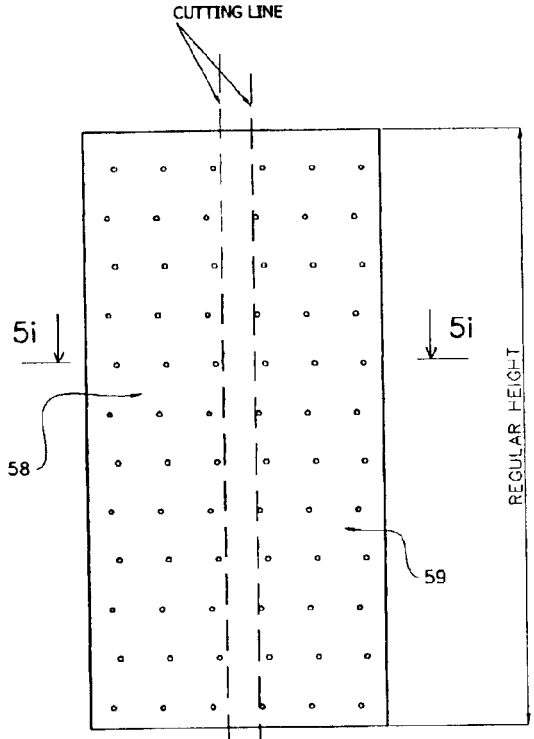

FIG. 5*e* is a plan view of technological operations for prefabrication of connectors for 3D construction corner forms;

FIGS. 5*f*, 5*g*, 5*h*, 5*i* illustrate the cutting of standard perforated panels required for prefabrication of 3D construction form. Panel configuration, placement and number of openings are shown conditionally;

FIGS. 5*f* and 5*g* illustrate the cutting of standard perforated panels to fit the prefabricated 3D construction corner form with connectors in FIG. 5*e;*

Figure 5H:
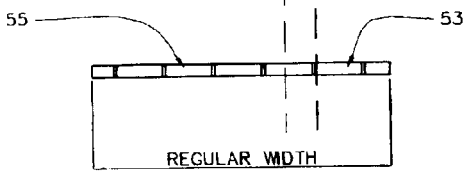
Figure 5I:
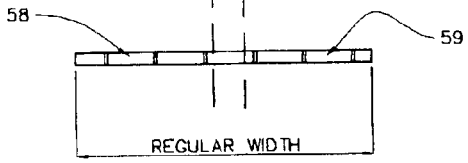

FIGS. 5*h* and 5*i* are horizontal cross-section views of FIG. 5*f* and FIG. 5*g;*

Figure 6:
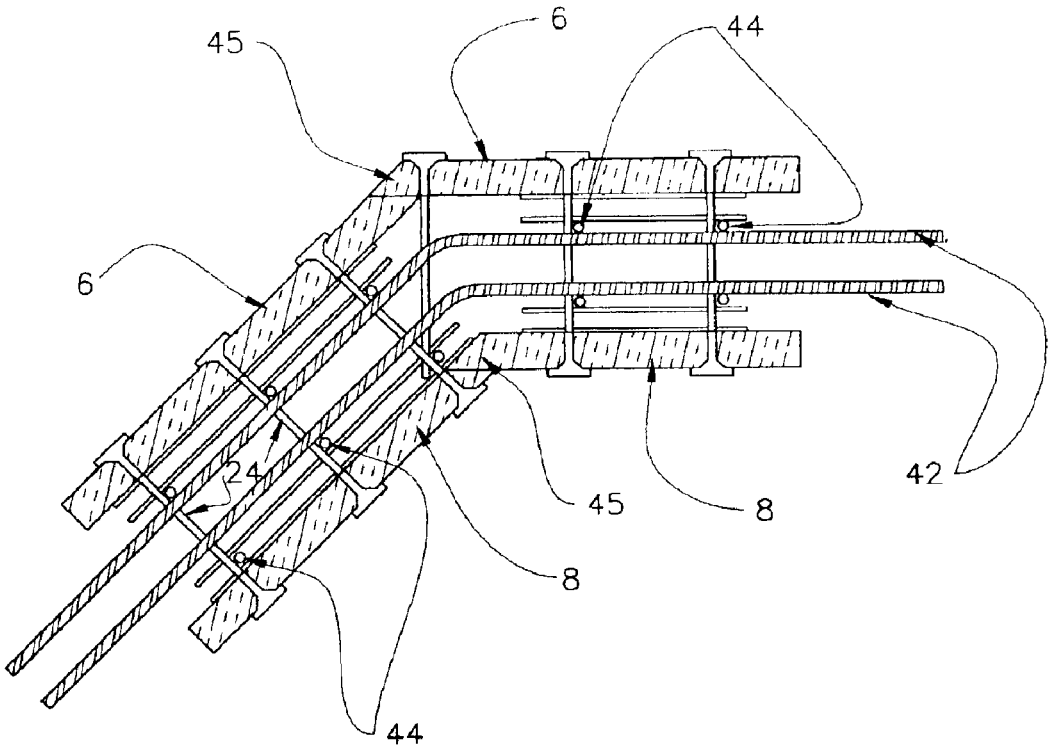
Figure 7:
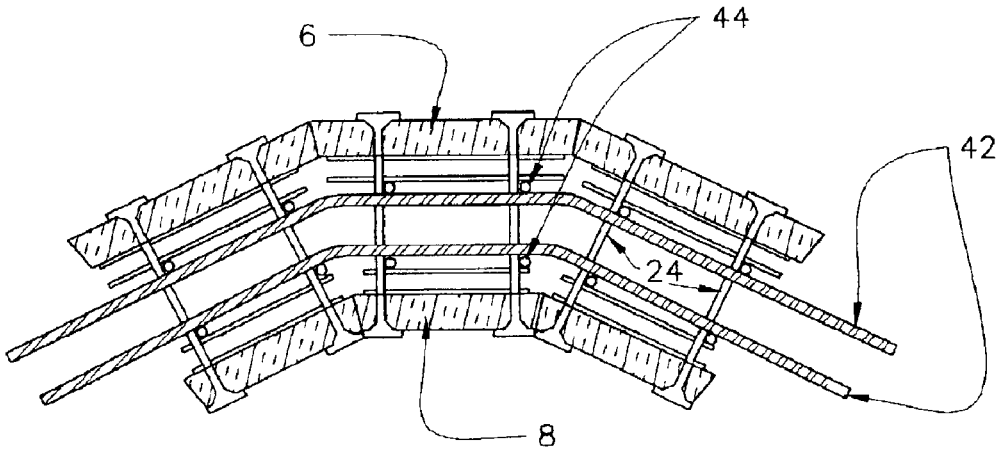
Figure 8:
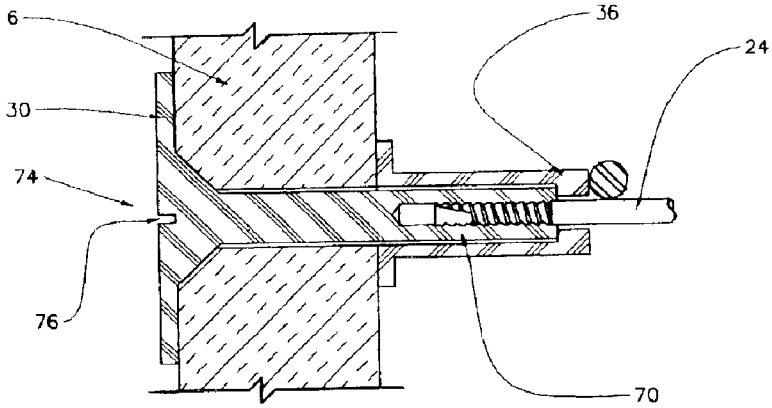
Figure 9:
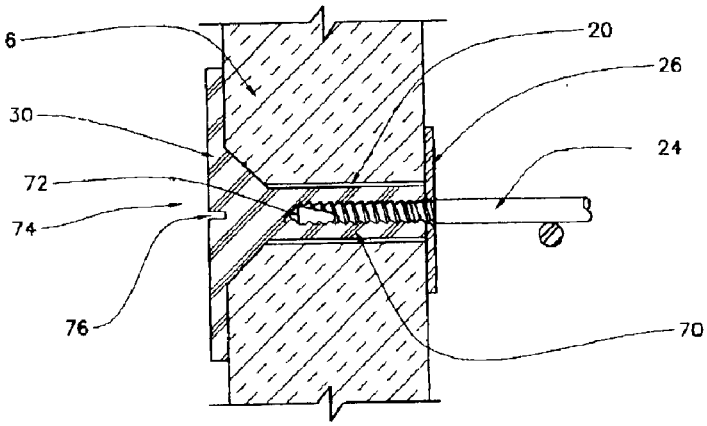
Figure 10:
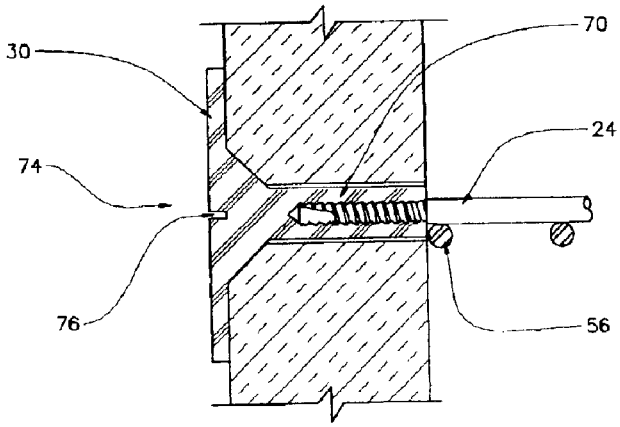
Figures 11A, 11B, 11C:
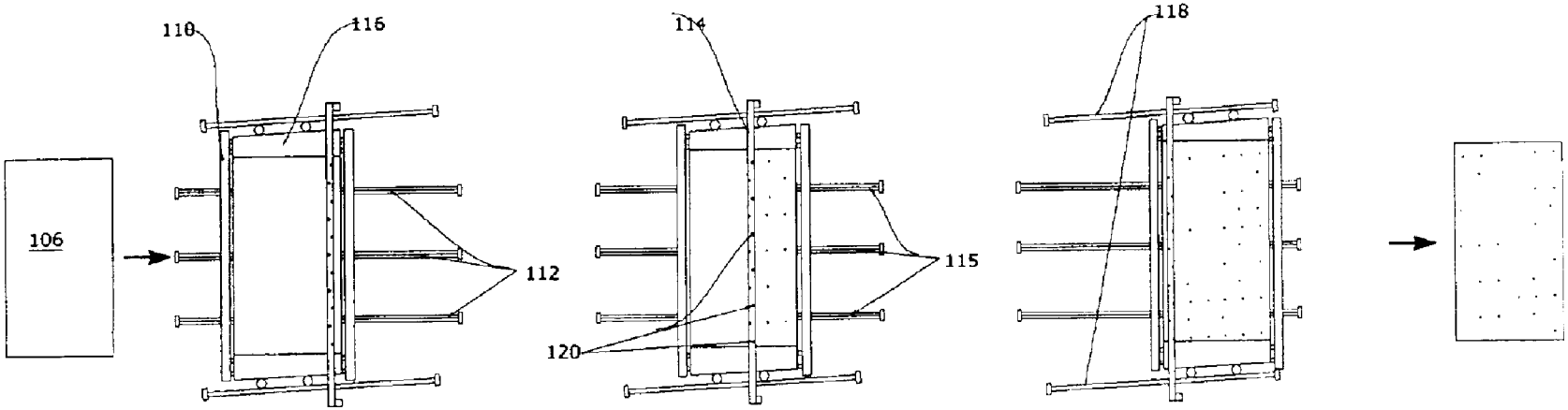
Figure 12:
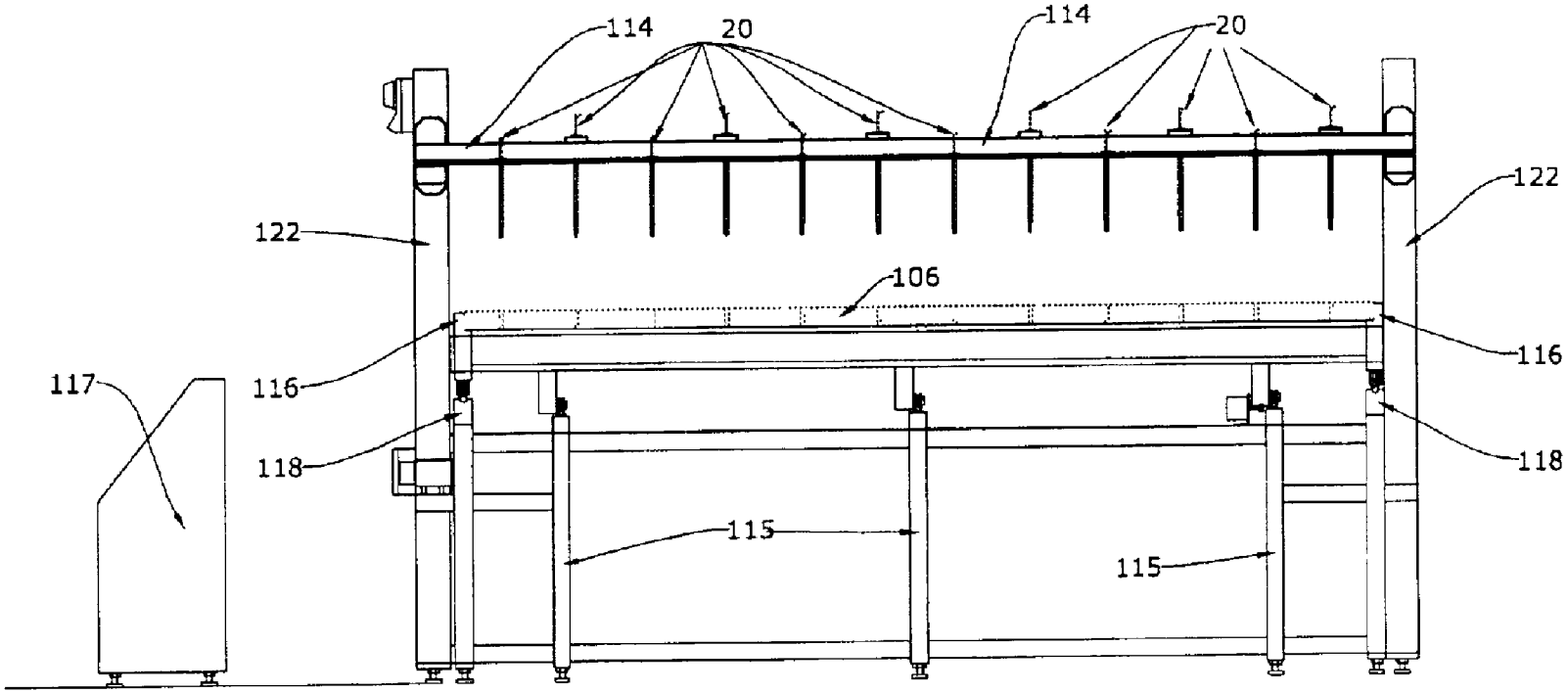
Figure 13:
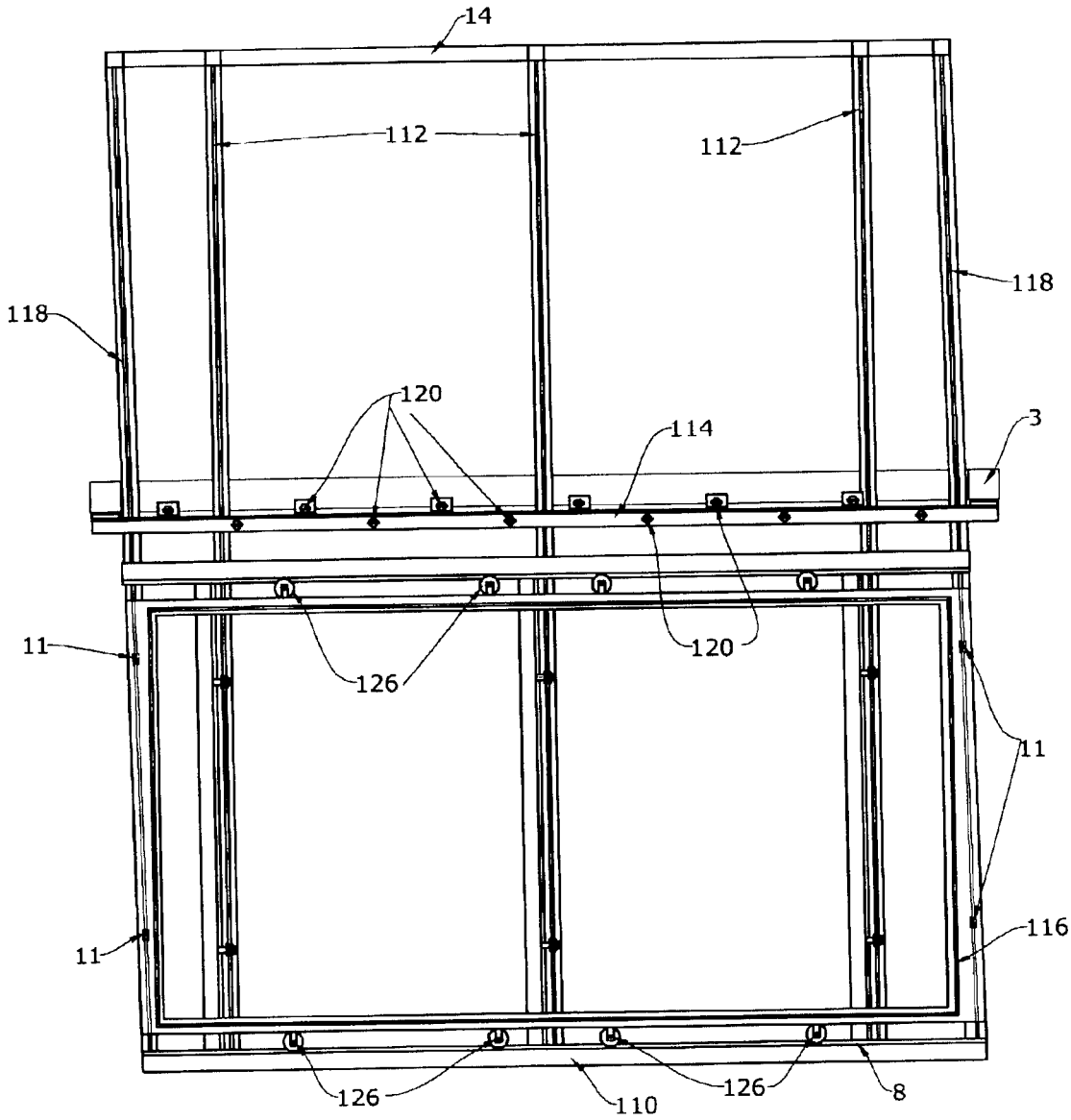
Figure 14:
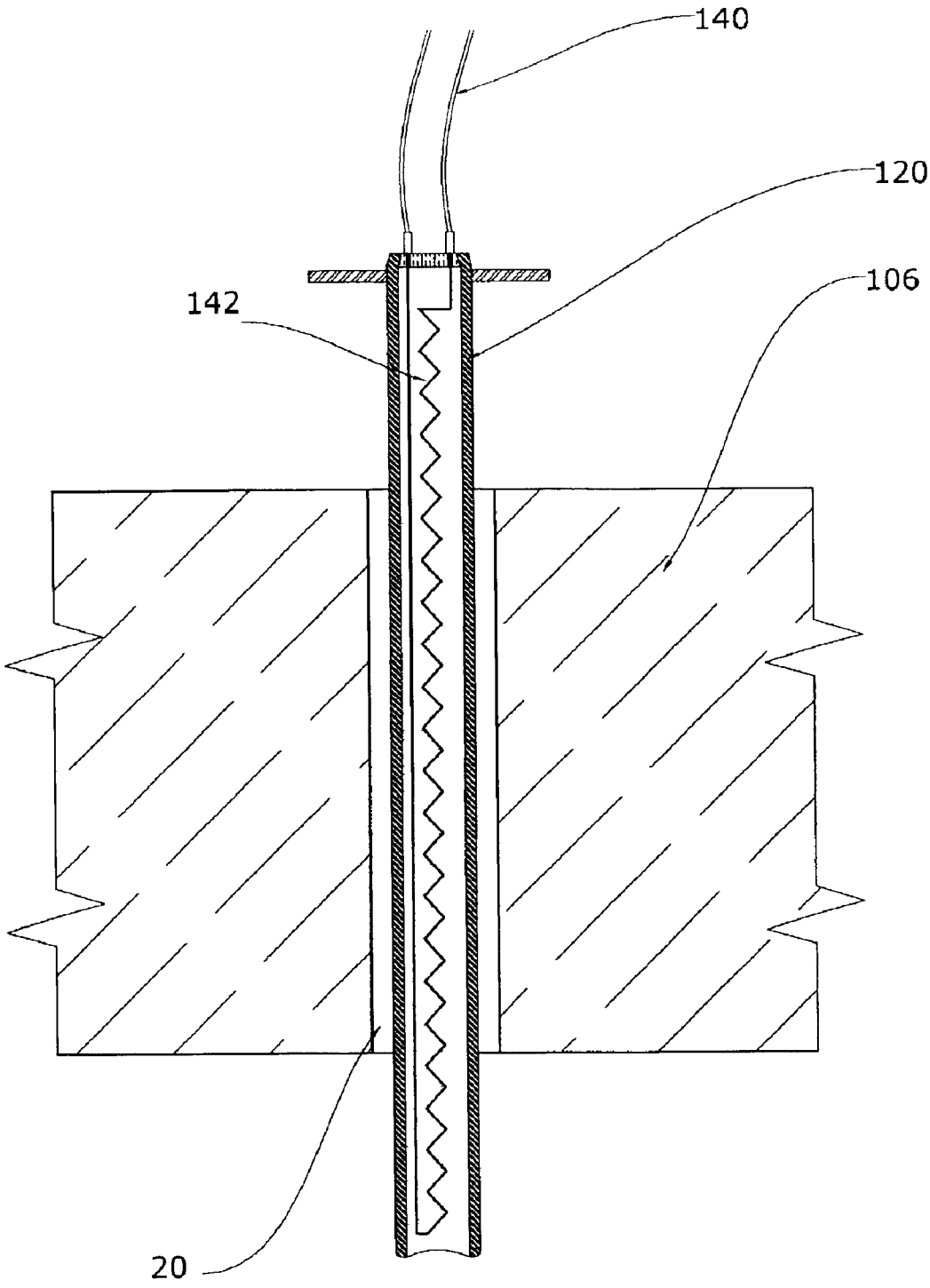
Figure 15:
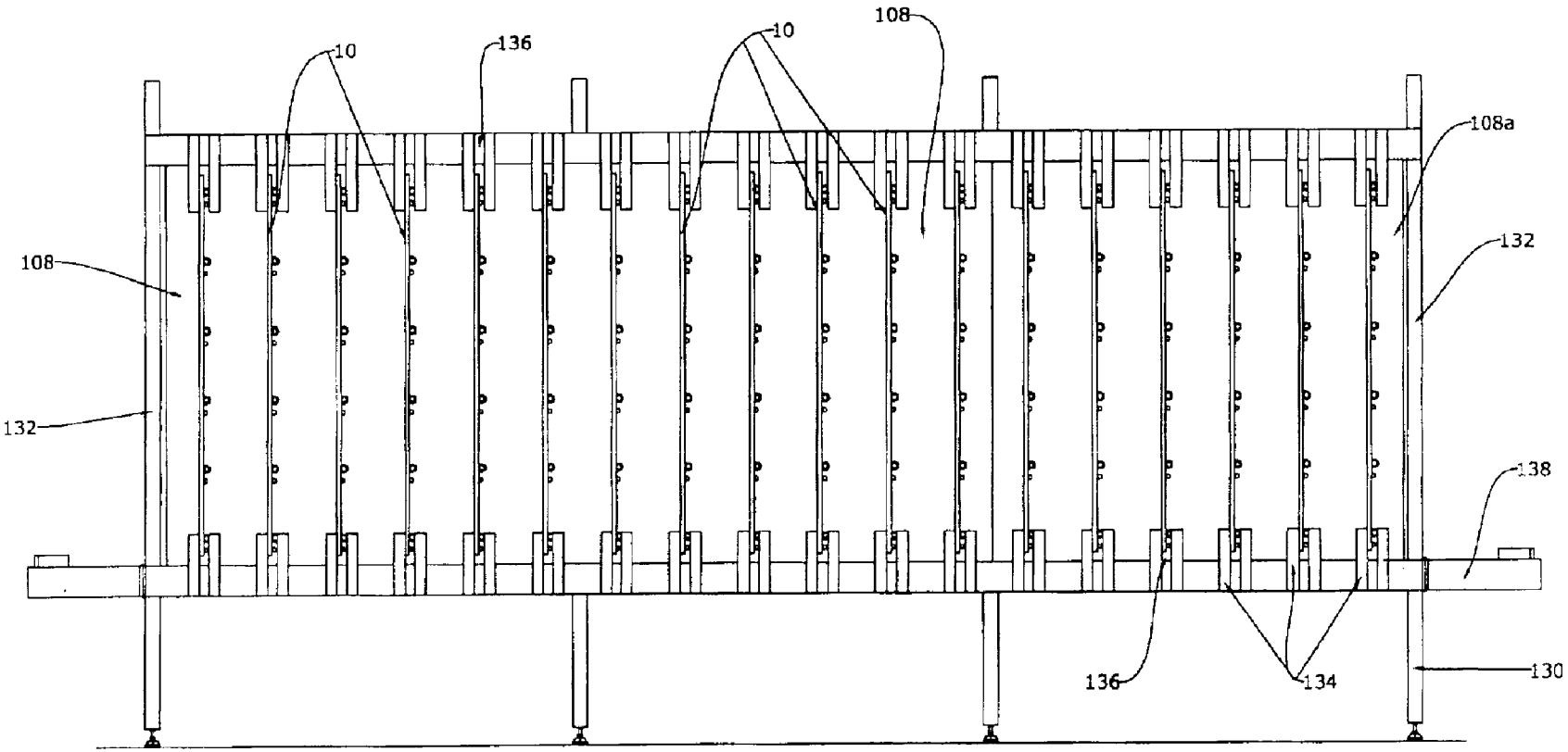
Figure 16:
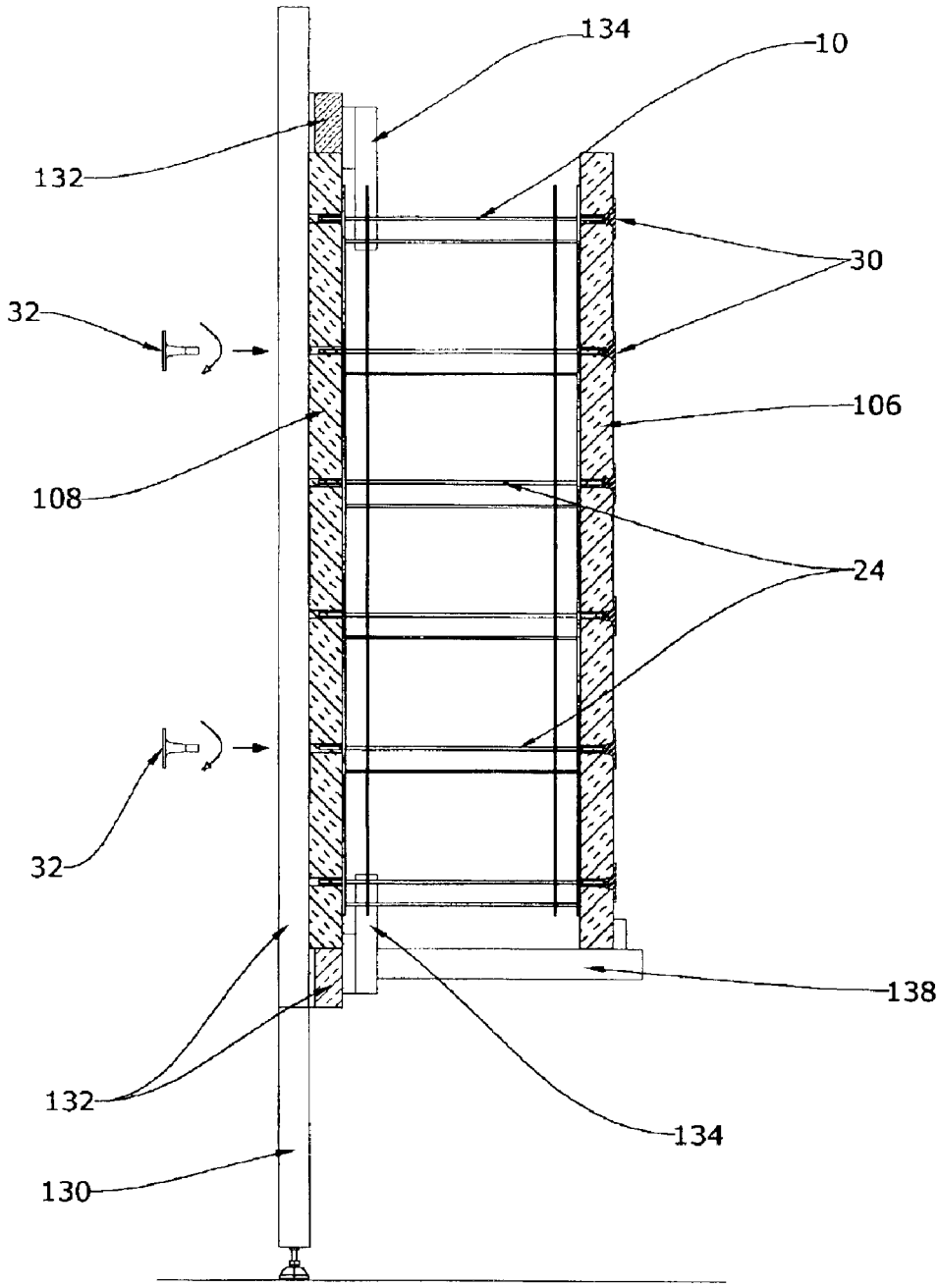
Figure 17:
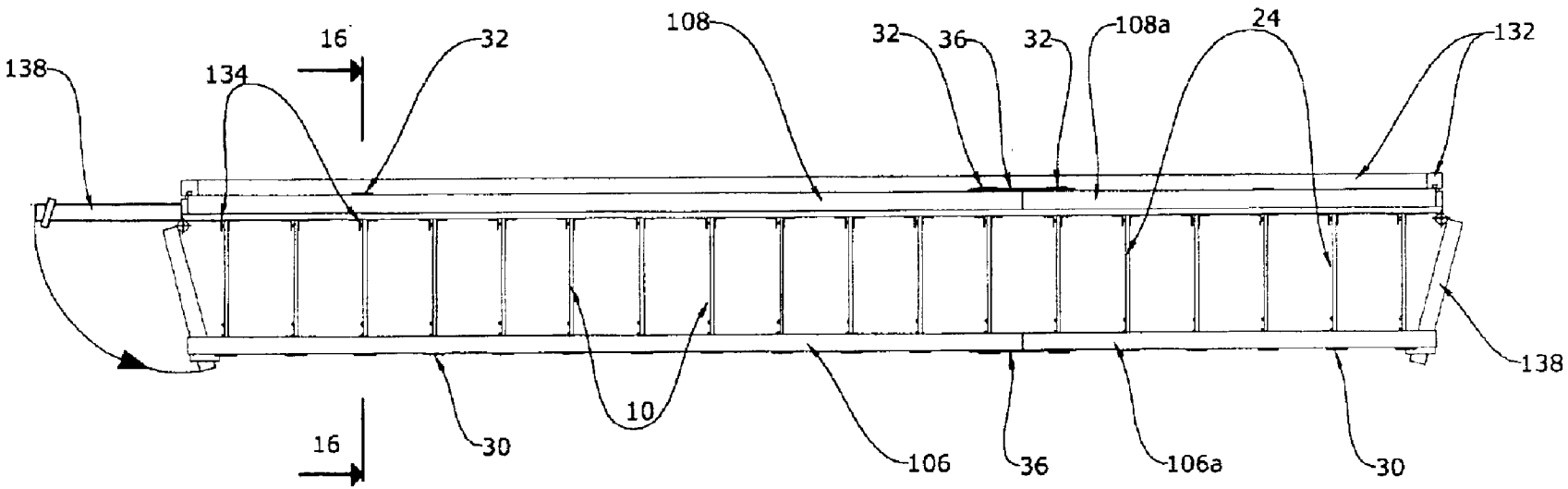

FIGS. 5*j*, 5*k*, 5*l*, 5*m*, 5*n* are a top view of sequent technological operations for prefabrication of 3D construction corner form. Panel configuration, transverse elements and connectors, as well as rotation of connectors are shown conditionally as an example of embodiment of the present invention;

FIG. 6 illustrates the top view of the present invention used for a reinforced concrete wall erection with prefabricated construction 3D corner forms of 135°;

FIG. 7 illustrates top view the present invention used to form a reinforced concrete curved wall erection with prefabricated construction 3D corners form, which is made in a form of multi-angle figure inscribed in a circle;

FIG. 8 is a cross-section showing an example of connection by which connectors are assembled to the panels by fasteners during 3D construction form prefabrication;

FIG. 9 is a cross-section showing an example of connection means by which connectors are assembled to the panels by connectors fasteners during 3D construction form prefabrication. Such connection is shown in FIGS. 1, 2A, 2B, 2C, 2D, 3A, 3B, 3C, 3D, 4, 5E, 5J, 5K, 5L, 5M, 5N;

FIG. 10 is a cross-section of an example of connection alternative form of connectors fastened to a panel by fasteners during 3D construction form prefabrication. Such connection is shown in FIGS. 7 and 8;

FIGS. 11*a*, 11*b* and 11*c* illustrate top view of the sequence of the process by which panels are perforated by means of apparatus for perforating panels;

FIG. 12 is an end elevation view of apparatus for perforating panels;

FIG. 13 is a plan view of the perforating apparatus in FIG. 12;

FIG. 14 is a vertical cross-section of the perforating tools in FIGS. 12 and 13 during perforation;

FIG. 15 is a front elevation view of the assembly apparatus;

FIG. 16 is a side elevation view of the assembly apparatus in FIG. 15 with prefabricated 3D construction form in place;

FIG. 17 is a plan view of the assembly apparatus of FIG. 15;

In the following description the terms "horizontal" and "vertical" are used to describe the illustrated embodiment but it should be understood that the present invention may be used in different orientations depending on the structure required, and the term "longitudinal" is meant to describe the horizontal continuance of a wall or section of prefabricated 3D construction forms where only a portion of the apparatus is shown. The term "transverse" is meant to imply a direction perpendicular to the plane of the wall or the plane of the panels in the following description.

Figure 1:
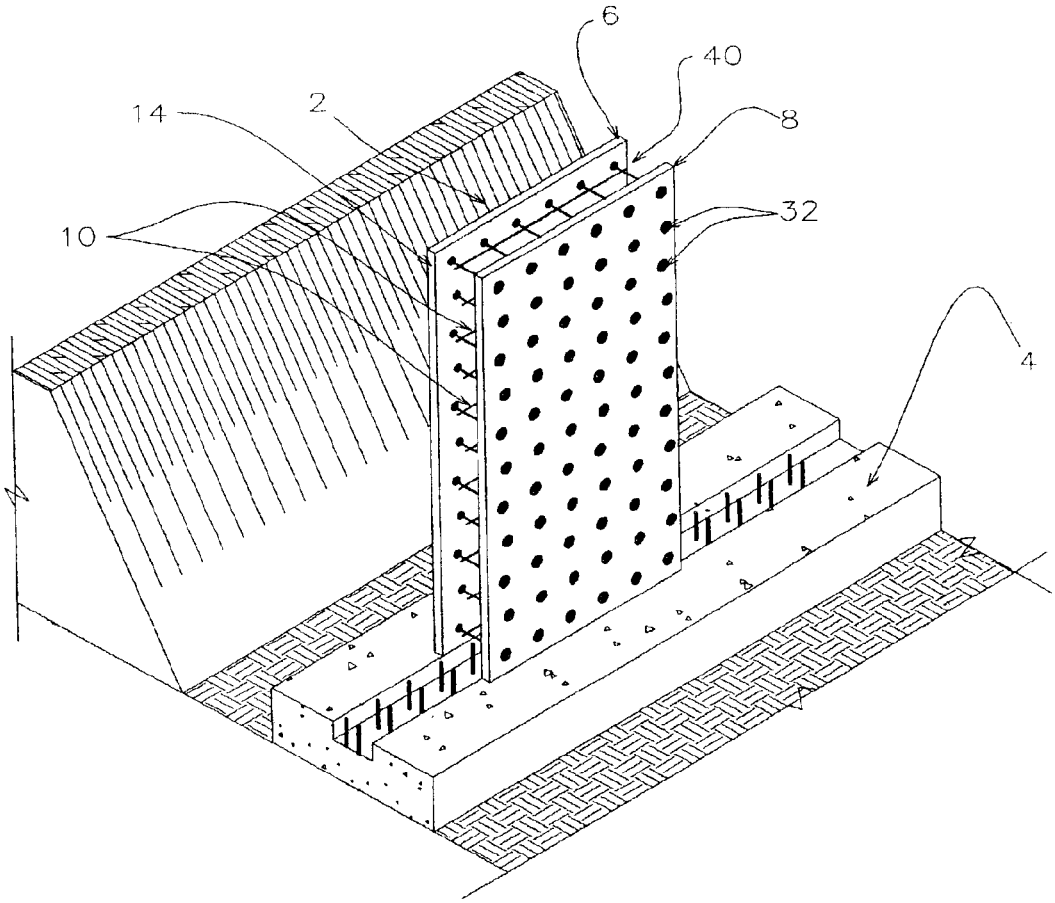
FIG. 1 is a perspective view of a typical prefabricated section of standard dimensions of 3D concrete construction forms of standard dimensions mounted on a foundation footing.

In the accompanying drawings, FIG. 1 illustrates a typical section of a prefabricated 3D construction form (which may be prefabricated and assembled in the remote location or at the site) in a section of concrete wall to be poured in place. In this illustrated embodiment the form 2 is shown vertically upright in an excavation and resting on footing 4, as in a typical structure which might be used as a foundation for a house, a wall of a building, old retaining wall or reservoir wall.

The prefabricated 3D construction forms shown comprise an outer panel 6 and an inner panel 8 held in parallel and aligned relationship by a series of horizontal connectors 10 which hold the panels at a spaced distance which represents the desired thickness of the concrete wall.

While the connectors 10 join the panels together, fasteners 32 mounted on the connectors (in a manner to be described later) bear against the outside surface of the panels to restrain them from moving apart under external forces during transportation or under the pressure of concrete during the pouring operation. The prefabricated 3D construction forms illustrated in FIG. 1 are especially adaptable for use with panels of insulating material such as expanded or extruded polystyrene. Panels for construction application come in preferably standard sizes, i.e., 4'×8' (1200×2400 mm), standard thickness (1½", 2", 2½", 3", 3½", 4") and standard density. It is therefore readily available pre-manufactured and in stock without requiring separate manufacturing other than modifications described hereinafter.

In the case of the embodiment shown in FIG. 1, the panels might well be of a standard dimension 4 ft×8 ft (or 1200 mm×2400 mm) which would provide effective transportation to construction site and abutment with other structural element of the building with standard sizes 4'×8', i.e. drywall, cement board and so on, and adequate headroom for a basement or a room, A series of segments as illustrated in FIG. 1 can be placed edge to edge along the footings to form an entire continuous wall (with or without reinforcing rods). At the end of a straight continuous wall a corner may be constructed by similar prefabricated 3D construction forms modified in such a way as to provide a corner of 90° or other desirable angle.

Figure 2:
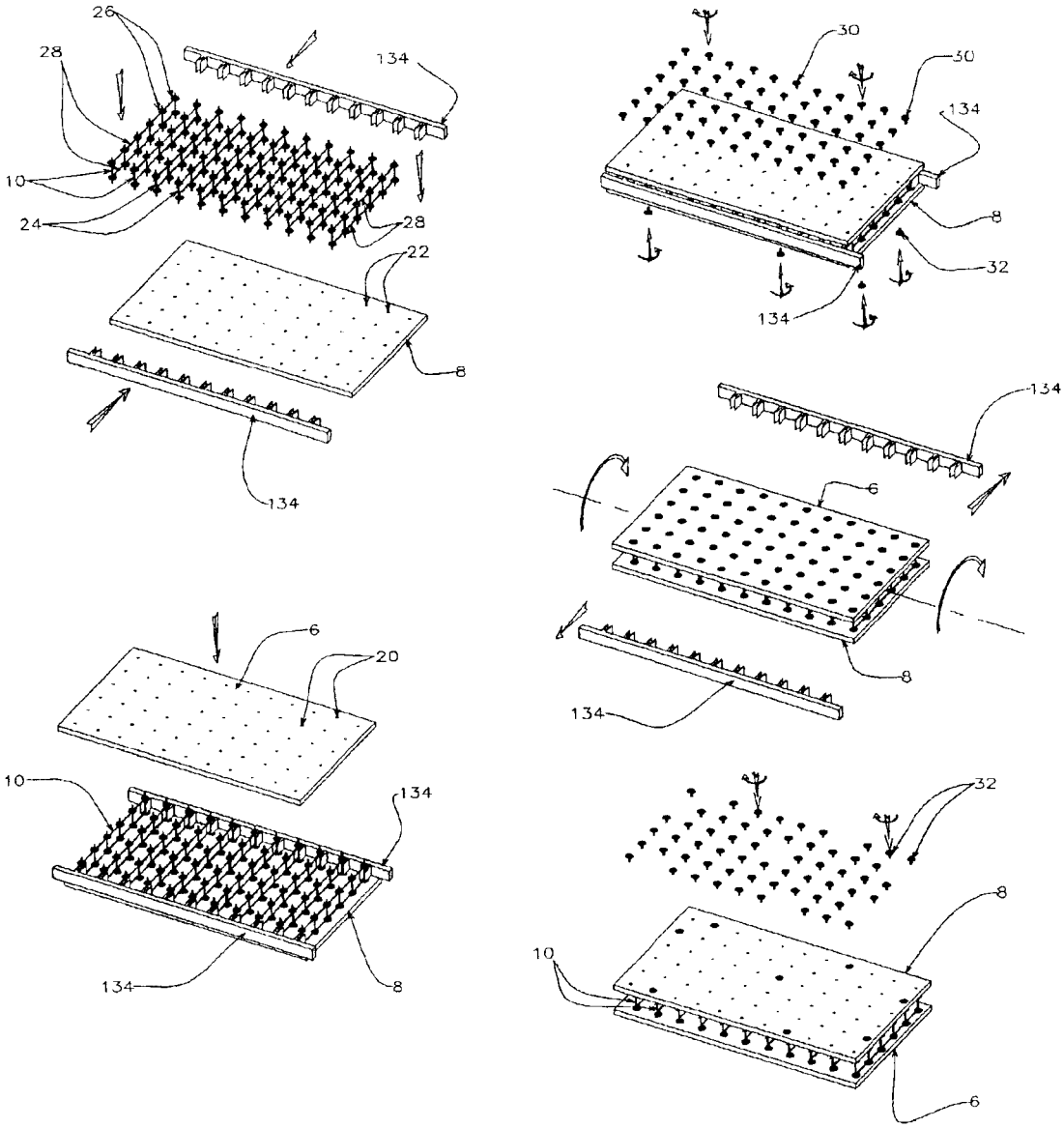
FIG. 2 is an exploded view of the components which are aligned and assembled together and technological operations for prefabrication to form the section of 3D construction forms illustrated in FIG. 1.
Figure 2A:
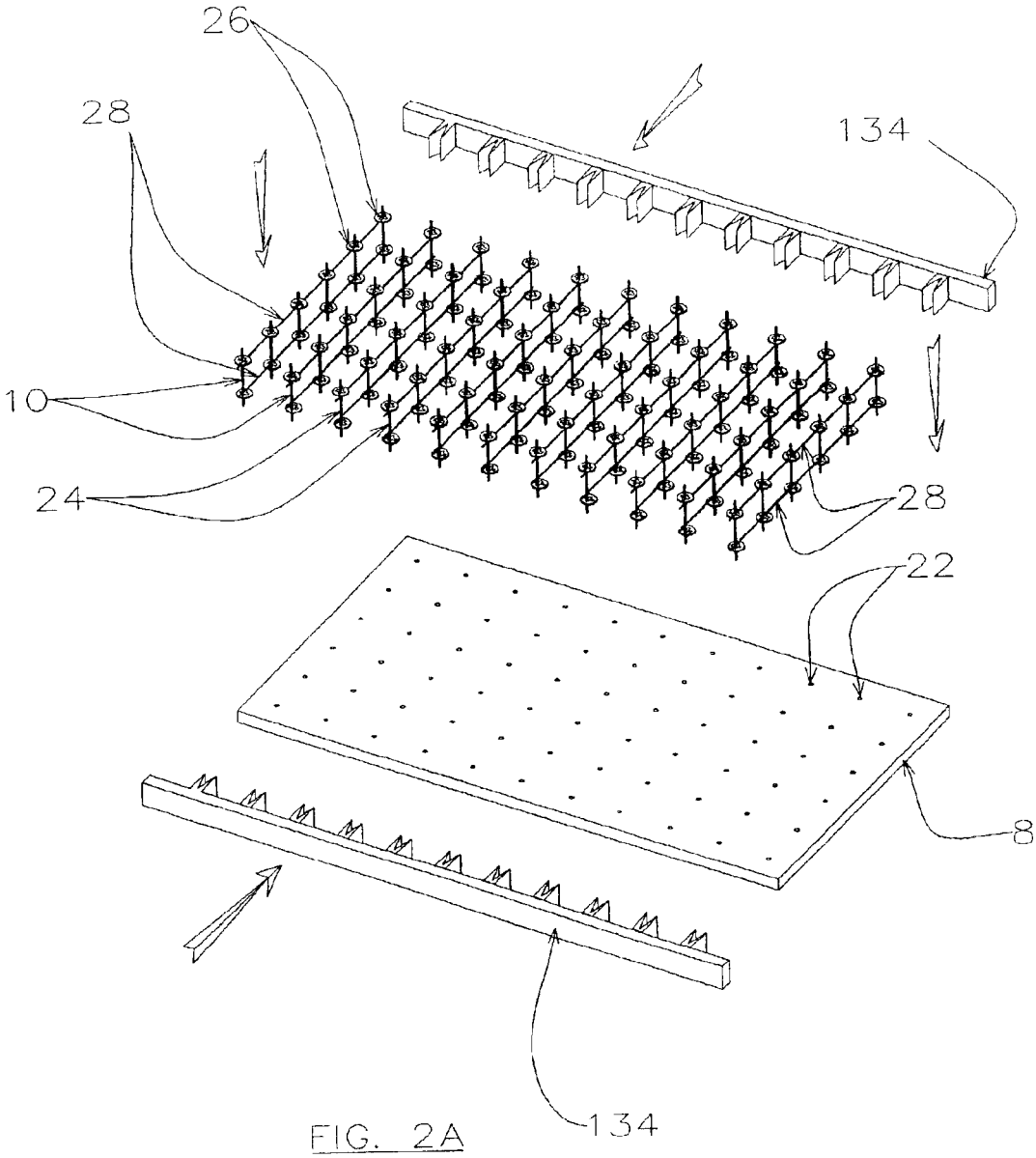
Figure 2B:
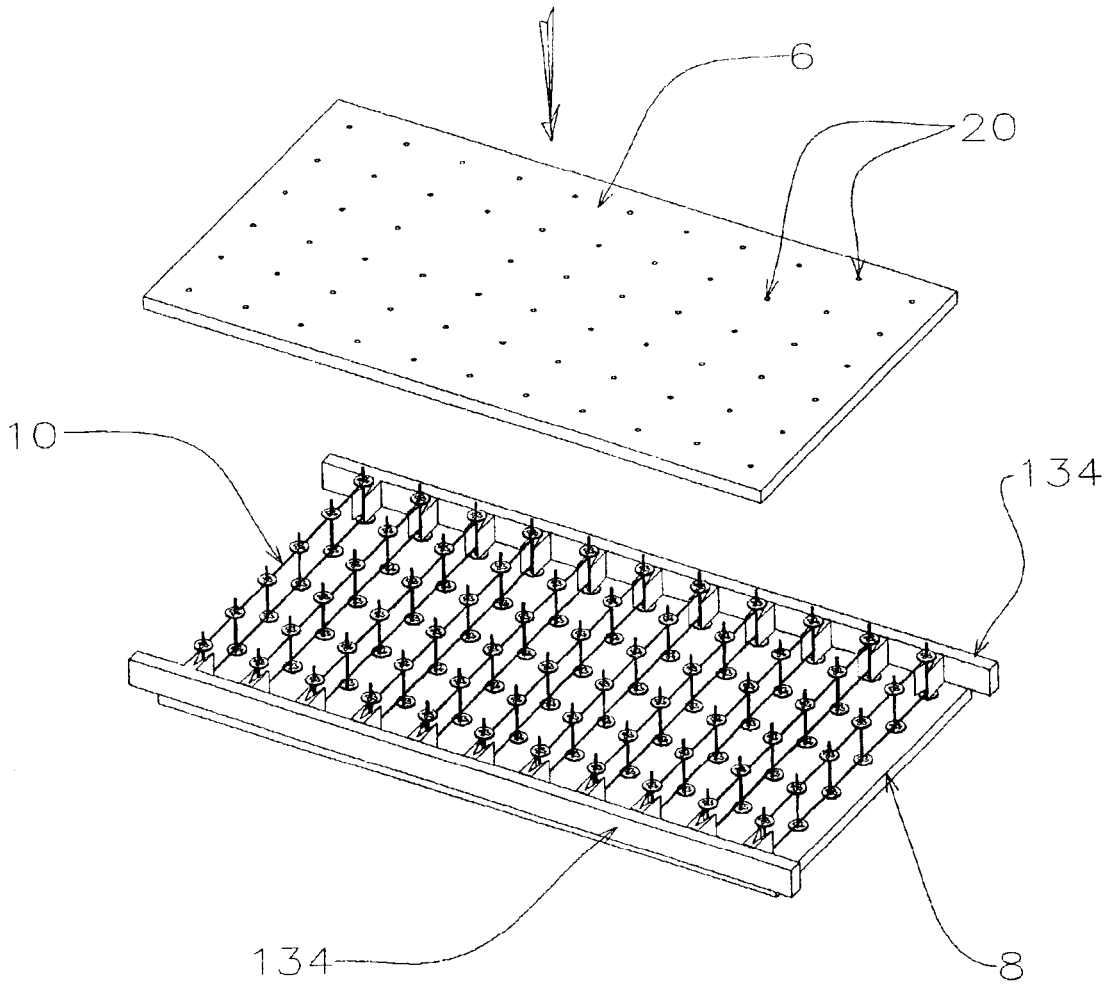
Figure 2C:
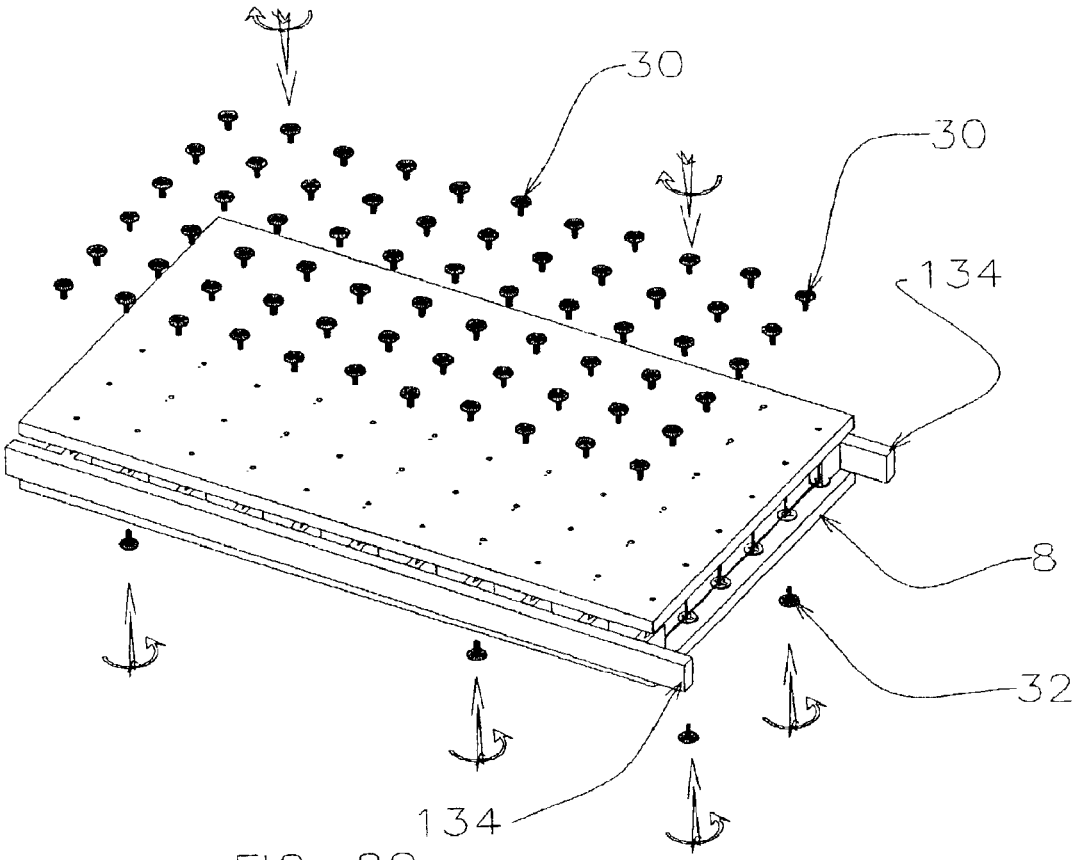
Figure 2D:
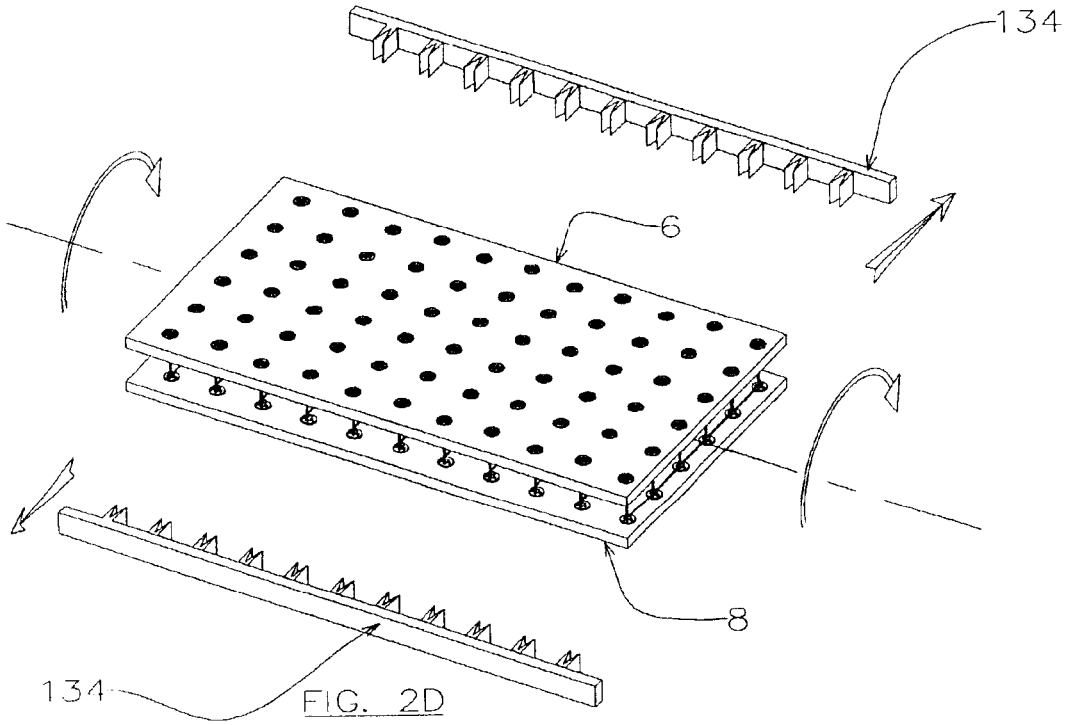
Figure 2E:
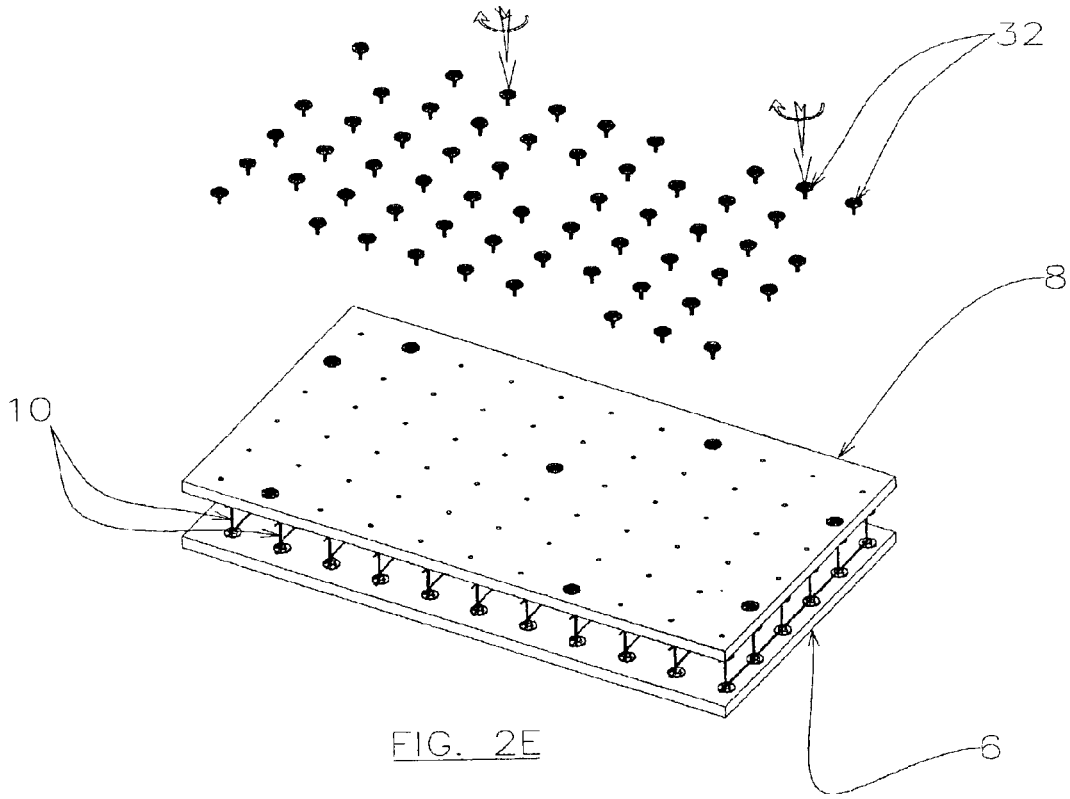

FIG. 2 illustrates in an exploded view the assembly of a typical section of prefabricated 3D construction forms as illustrated in FIG. 1. In FIG. 2 the outer panel 6 and the inner panel 8 are each provided with a pattern of corresponding perforations 20 and 22 respectively, the spacing of which corresponds to the spacing of the connectors 10, which are assembled between the panels to maintain their spacing. The perforations 20 and 22 extend entirely through the thickness of the panels.

FIG. 2 is a perspective view of the initial operation for prefabrication of the 3D construction form, transverse elements of the form, by means of their details provided for securing the first panel, align with the openings of the first perforated panel of the standard size, said openings are made on the device for perforating panels shown in FIGS. 11*a*, 11*b*, 11*b*, 12, 13. Configuration of the first perforated panel and transverse elements is shown conditionally as one of the samples of the embodiment of the present invention.

FIG. 2 the inner panel 8 preferably 4'×8' size and 2" thickness, preferably with density 30 kg/mc, provided with perforations 22 with preferable diameter 8–12 mm. Said perforations are positioned at a distance in accordance with the sports of fixation of connectors 10 with fasteners 30.

The connectors 10 comprise a number of transverse rods 24 with diameter 4–8 mm, each having a pair of stoppers 26 spaced between them at a distance sufficient for reinforced concrete wall erection of the required thickness. The spots of abutment of transverse rods 24 and stopper 26 also are to allow reliable connection of transverse rods 24 with fasteners 30. In this Figure, as an example of embodiment of the present invention for method illustration, prefabrication of 3D construction form is shown for wall erection with thickness of 8'. In this embodiment, the transverse rod with diameter 5 mm, of the connector having length 11" is shown, and each end having a special self-thread for connection with a plastic part with length 1½".

Stopper 26 of connector 10 may be used in any structure, some of which are shown in FIGS. 8, 9, 10. In present Figure, it is shown as a flat metal nut with diameter 35 mm and mounted on transverse rods 24 prior to fabrication of the 3D construction form, said nut abuts into the body of transverse rod 24 without thread. Stoppers 26 are spaced from each end of transverse rods 24 at 1½" in pairs, and at 8" between themselves.

In order to increase rigidity, aid in assembly, and to maintain the transverse rods in the proper horizontal spacing, a series of longitudinally extending, horizontally disposed tie rods 28 are connected to the transverse rods at a point immediately inboard of the stoppers 26, between the inner and outer panels. In fact the tie rods 28 may be used to hold the stoppers 26 at the desired distance from the end of the transverse rods. Ideally, the tie rods are welded or fused to the transverse rods, and may in fact be used to bear against the inner surface of the panels instead of stoppers. Tie rods 28 are made from metal bars with diameter 3 mm and length 1050 mm.

FIG. 2 illustrates that once the ends of the transverse rods are inserted in the perforations of the panels 8, all fasteners 30 and 32 respectively are inserted into the outboard ends of the perforations 20 and 22 respectively, and are threadably engaged to the ends of the transverse rods (as described later) until they press against stoppers 26 and the outer surfaces of the panels to hold the panels forms together, and resist the outward pressure of the poured concrete.

In FIGS. 3*a*, 3*b*, 3*c* the assembly of the 3D construction forms for wall erection of non-standard height (higher than 8') is shown in vertical elevation. In this view the panels 8 and 8*a* are positioned vertically in end abutment towards each other and the connectors 10 are inserted in perforations 22 so that they extend horizontally and longitudinally with a vertical spacing corresponding to the pattern of the perforations in the panels and interval between themselves. The outer panels 6 and 6*a* are positioned vertically in end abutment towards each other. Panel 6 is positioned opposite to panel 8 and 8*a*, and panel 6*a* is positioned in opposite the panel 6.

In FIGS. 3*a*, 3*b*, 3*c* a standard panel 6 similar to the one illustrated in FIG. 1 has an additional portion 6*a* added to the top while the panel 8 has an additional length 8*a* added at the bottom, and the two pieces are fastened together by a plate 36 which extends between and joins together the two adjacent fasteners 32 on either side of a joint 38 where adjoining pieces of panel abut. This allows for a wall of approximately 10 or 12 feet in height.

FIG. 4 illustrates a prefabricated 3D construction form of non-standard height, the technological process of prefabrication of which is shown in FIGS. 3*a*, 3*b*, 3*c* assembled mounted on a footing 4 and the fasteners 30 and 32 are in place while the panel sections 6 and 6A and 8 and 8A are held together by plates 36.

In the illustrated embodiment in FIGS. 1, 2, 3 and 4 the outer and inner panels 6 and 8 provide not only a form into which poured concrete can be cast in place in the void space 40, but the panels themselves, if made of rigid, thermally insulating material such as expanded or extruded polystyrene, provide an inexpensive durable and effective insulation on both the inner and outer wall surfaces of the poured concrete wall. These surfaces may also be used to affix various surface treatment such as waterproofing or drainage fabrics as might be used on the outside of an in-ground basement, or a stucco or plaster wall which might be a decorative surface used above ground. The inner panel on the inside surface of the concrete wall might be used to affix a plaster surface or paneling on the inside wall of a finished basement or room. The use of flat standard sized (4'×8') pre-manufactured polystyrene insulation panels will frequently provide fabrication of 3D construction forms of an ideal dimension from in-stock material.

It should also be realized that the horizontally positioned connectors 10 provide an ideal support and positioning device for the placement of reinforcing rods if the concrete wall is required to be steel reinforced.

While the segment of forms illustrated in FIGS. 1–4 provide for a straight vertical horizontally extended wall, there will inevitably be a need for corners and FIGS.

5–5*k*–5*n* illustrate a manner in which a modified embodiment of the present invention may be used to provide a 90° corner.

FIG. 5 illustrates a connector 50, similar to connector 10, in which a series of transverse rods 24 have a pair of tie rods 56 and 57. Stoppers 30, similar to stoppers 26, are not installed onto the ends of transverse rods 24.

FIG. 5*a* illustrates how the connector can be cut at 53 so as to form a right angle corner illustrated in FIG. 5*b* which is additionally modified by the placement of an auxiliary transverse rod piece 54 welded to the last transverse rod at 52 and at the same spacing as the rods 24 in the adjacent wall around the corner. It should be realized that the auxiliary transverse rod piece 54 needs to be welded to the perpendicular tie rods in the same plane so as to be aligned with the appropriate perforations in the outer panels. The alignment is shown in the elevation views of FIGS. 5*c* and 5*d*.

By cutting the tie rods 56 and 57 at the appropriate lengths so that they abut the tie rods 56 and 57 of the adjacent wall, the proper spacing of the transverse rods will be established and the corner connectors can be welded together.

FIG. 5*e* illustrates how bent reinforcing rods 42 may then be positioned horizontally on the connectors to form a strong corner connector for prefabricated 3D construction corner form and reinforcing a concrete wall corner. By welding or other means the reinforcing rods may be fixed to the corner connectors to hold them in place. Also, it is shown, how stopper 30 are put onto the ends of transverse rods 24. Fragment of said connector with the stopper is shown in FIG. 9.

Figure 5J:
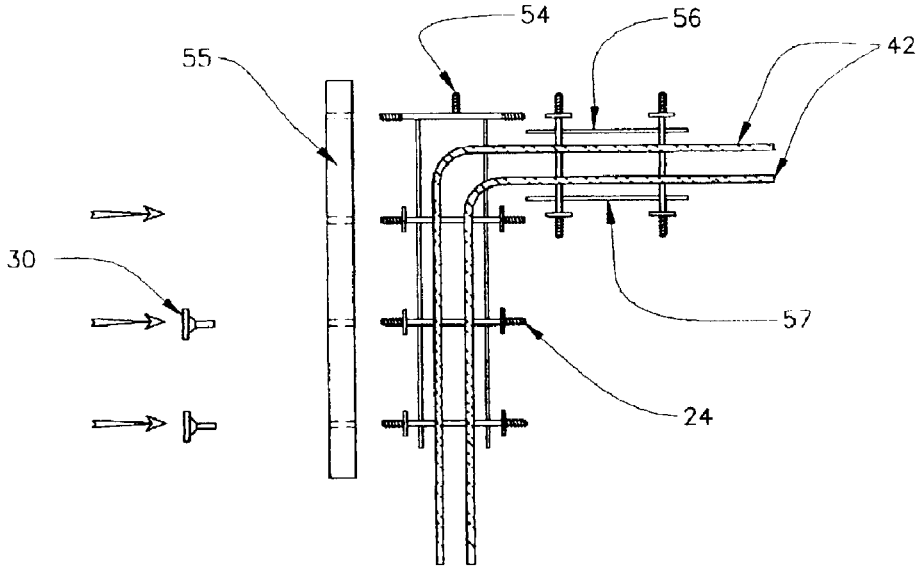

FIGS. 5*f* and 5*h* illustrate how an outer panel, such as 6, may be cut lengthwise to provide an outer corner panel 55 for a corner section as illustrated in FIG. 5*j*. Another piece 53 from the standard panel may be cut to fit the inner corner panel as illustrated in FIG. 5*j*.

FIGS. 5*g* and 5*i* illustrate another standard perforated panel which may be cut as illustrated to provide the adjacent outer corner panel 58 and the adjacent inner corner panel 59.

FIG. 5*j* illustrates the initial technological process for fabrication 3D corner construction form on the assembly apparatus. Assembly apparatus comprises a frame and movable holder 136 with details 134 provided to temporary hold corner connectors vertically. First outer corner panel 55 is positioned by its openings with details provided for fixation panel 55 of the corner connector with fasteners 30. Connectors are temporary held with said assembly apparatus. The nearest to the corner fastener is not inserted in the opening 20.

Figure 5K:
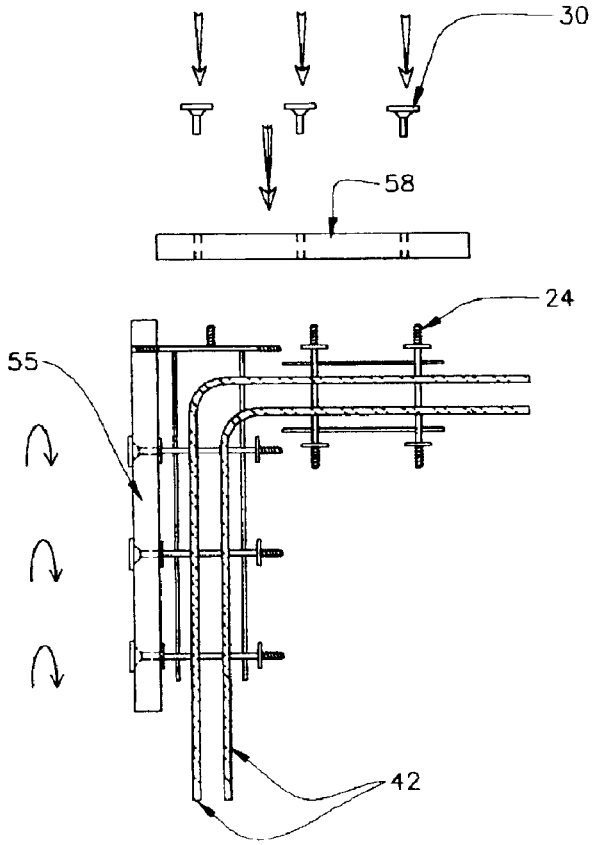

FIG. 5*k* illustrates how the second outer corner panel 58 is positioned by its openings with details provided for fixation panel 58 of the corner connector with fasteners 30. Also, fixation panel 55 with fasteners 30 is shown in this Figure (except fasteners adjacent to the top of the corner). With this, openings 20 are reshaped as fasteners 30 by crushing the body of the polystyrene panel, that action allows blocking said openings and permits keeping water in freshly poured concrete at reinforced concrete wall erection.

Figure 5L:
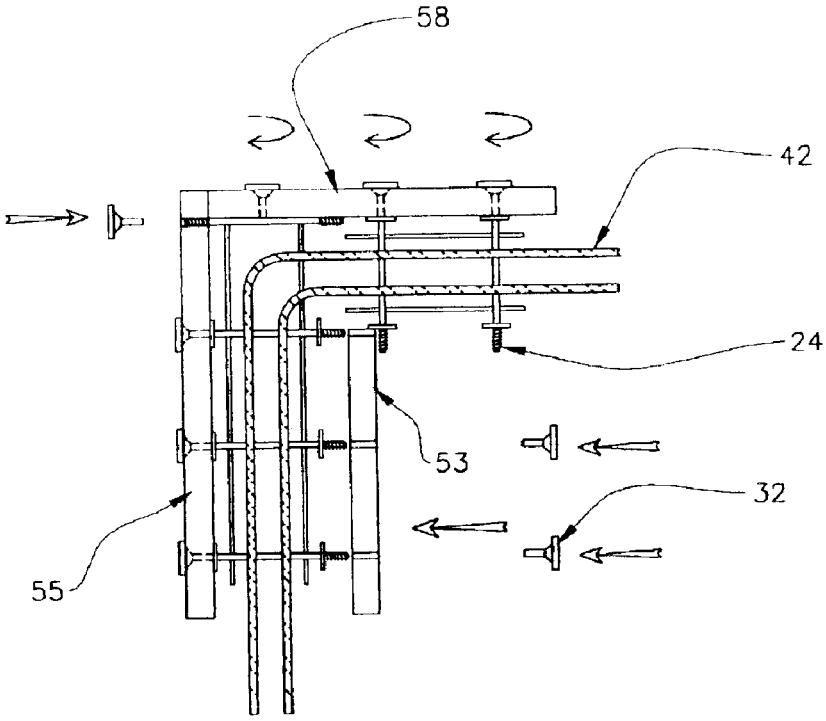

FIG. 5*l* illustrates the next step in which fasteners 30 fix panel 58 to the corner connector. Openings 20 are reshaped as fasteners 30 crush the body of the polystyrene panel. Afterwards, fasteners 30, which were not installed in the panel 55 earlier, are inserted in the openings now and fixed to details of the corner connector provided for their fixation in the pot of the corner. Afterwards, inner corner panel 53 is positioned by its openings with details provided for fixation panel 53 of the corner connector with fasteners 32.

Figure 5M:
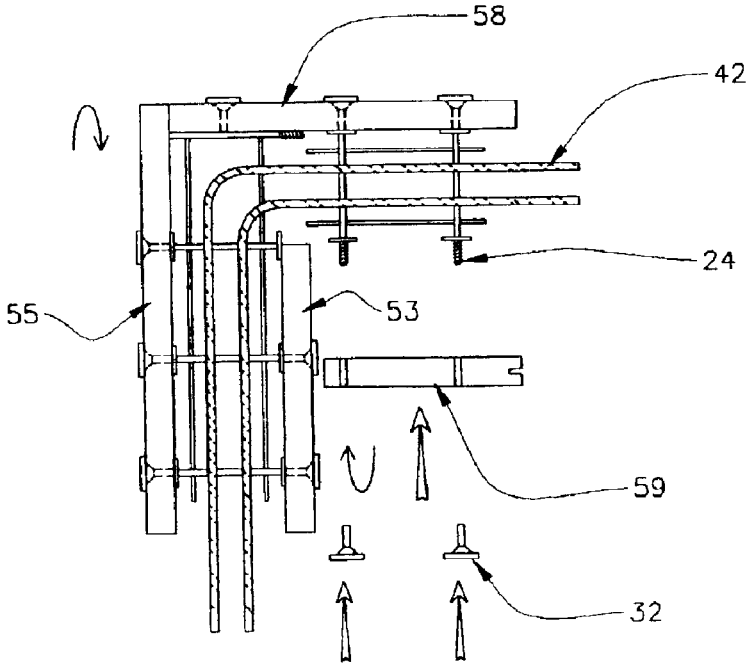

FIG. 5*m* illustrates fixation fastener 30 to panel 55. With this, openings 20 are reshaped as fasteners 30 crush the body of the polystyrene panel, and seal the openings. The same action occurs with the openings 22 of the panel 53 at its connecting with fasteners 32. Afterwards, second inner corner panel 59 is inserted on the rods 24 and held by fasteners 32 is positioned by its openings with details provided for fixation panel 59 of the corner connector with fasteners 32.

Figure 5N:
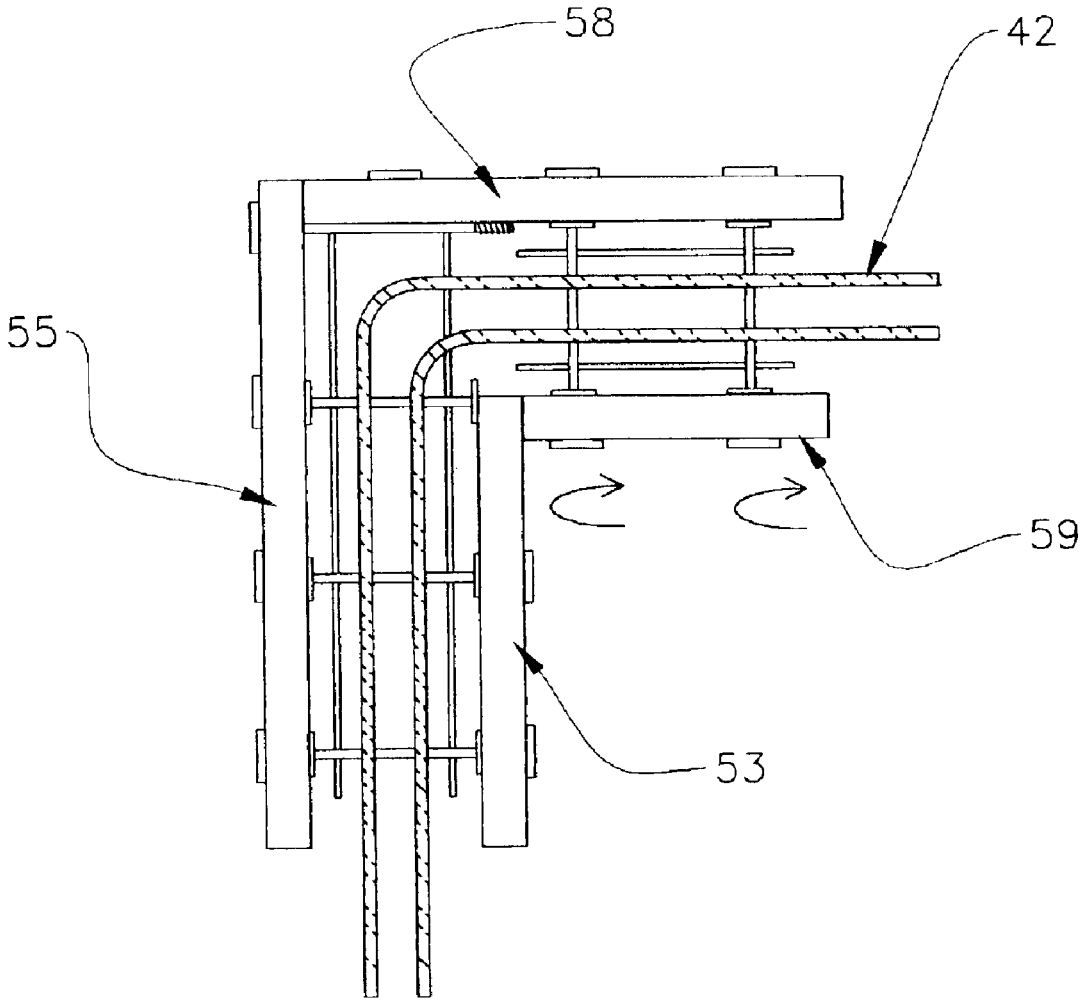

FIG. 5*n* illustrates the forms for a corner section fully assembled with the reinforcing bars 42 in place. Said method for prefabrication of 3D corner construction form allows creating 3D corner construction form from standard elements used for 3D construction forms for straight walls. Also, said method does not require special details to resist pressure caused by freshly poured concrete. Said method forced the ends of the polystyrene panels to resist pressure caused by freshly poured concrete. End of panel 55 holds end of panel 58 and end of panel 59 holds the end of panel 53.

FIG. 6 illustrates a modified prefabricated 3D construction form in which the panels 6 and 8 and connectors have been adapted to provide forms with a corner (with reinforcing rods 42 and 44) at an angle of 135°. The corners of the panels can be mitered to support the edges as shown at 45. Panel cutting can be similar to FIGS. 5*f*, 5*g*, 5*h*, 5*i*. Connector used for 3D construction form for straight wall is modified to corner connector for 3D corner construction form with angle of 135° similar to technological process of modification of connector for 3D corner construction form with angle of 90° as in FIGS. 5*a*, 5*b*, 5*c*, 5*d*, 5*e*. Configuration of connector and fastener is shown in FIG. 10. Panels, connectors and fasteners for fabrication of said 3D corner construction forms and any other types of corners can be used from standard elements used for 3D construction forms for straight walls.

FIG. 7 illustrates a modified prefabricated 3D multi-angled construction form with panels and connectors providing reinforced concrete curved walls erection using connectors similar to those illustrated in FIG. 5 and FIG. 6.

FIG. 8 is a cross-sectional drawing which illustrates the connection of the panel 6 with transverse rod 24 of connector 10 provided with stopper 36 and fastener 30. Also, this is a sample of joining mechanism for connectors and panels, said mechanism may be used during embodiment of the method for prefabrication of 3D construction forms. This Figure illustrates how the transverse rods 24 of connector 10 joined with stopper 36 are positioned with the perforations 20 or 22 of the panels 6 or 8. The panels are pressed against the stoppers 36 by means of the fasteners 30 or 32 which have a hollow stem 70 designed to snugly engage the threaded portion 72 on the end of the transverse rods 24. The fasteners are provided with slots or indentations 76 on the head 74 so that a tool may be used to rotate the head of the fastener to engage the helical threads so that the fastener head 74 is driven inwardly against the panel 6 until it presses firmly against the stopper 26. If the fastener 30 is made of a semi-rigid material, such as nylon or polypropylene, the stem of the fastener does not need to be threaded because the end of the transverse rod will cut into material and form a strong mechanical attachment. Furthermore, the openings 20 and 22 are reshaped by the fasteners 30 and 32 which crush the body of the panel and block the openings.

FIG. 9 is a cross-sectional drawing which illustrates in greater detail how the transverse rods 24 penetrate the perforations 20 or 22 of the panels 6 or 8. The panels are pressed against the stoppers 26 by means of the fasteners 30 or 32 which have a hollow stem 70 designed to snugly engage the threaded portion 72 on the end of the transverse rods 24. The fasteners are provided with slots or indentations 76 on the head 74 so that a tool may be used to rotate the head of the fastener to engage the helical threads so that the fastener head 74 is driven inwardly against the panel 6 until it presses firmly against the stopper 26. If the fastener 30 is made of a semi-rigid material, such as nylon or polypropylene, the stem of the fastener does not need to be threaded because the end of the transverse rod will cut into material and form a strong mechanical attachment.

FIG. 10 illustrates in similar detail the fastener means 30 by which the panel is attached to the connectors and the panel is pressed to a position abutting tie rods such as 56.

Although FIG. 9 and FIG. 10 show a configuration in which the stopper 26 or the tie rod 56 are used to position the panels by bearing against the inner surface of the panels, it should be realized that it may be advantageous to use a form of stopper on the transverse rod 24 which is positioned to bear against the end of the stem 70 of the fasteners 30 or 32, and in this way the fastener will be prevented from advancing too far onto the threaded portion 72 of the transverse rods 24, thus preventing the fasteners from splitting.

It will, of course, be realized that hardness of the plastic (or other material) in the fastener, the dimensions of the threads on the transverse bar, the number and spacing of the connectors and transverse bars which engage the panels, and the strength of all materials (including the panels) are design considerations, and will determine how much concrete can be poured in a set of forms, and the time which must be allowed for hardening to avoid creating a hydraulic head sufficient to rupture the forms.

FIGS. 11*a*, 11*b*, and 11*c* illustrate the sequence of operations by which the panels such as 6 and 8 are provided with the perforations 20 which not only allow assembly of the forms but position the connectors and transverse rods in the proper location to construct the prefabricated forms and receive the reinforcing rods.

In the aforementioned drawings a standard sheet of expanded polystyrene, or similar material 106 is loaded on to a cart 110 which moves along parallel tracks 112 supported by columns 115, in the direction of the arrows. A beam 114 is positioned above the cart and the panel and supports a series of probes 120 designed to penetrate the polystyrene panel to form a pattern of perforations such as 20 and 22, two rows of which have been shown to be created in FIG. 11*b* and a complete set is shown in FIG. 11*c*.

Although the cart 110 moves along the parallel tracks 112 in a direction perpendicular to the beam 114, the polystyrene panels are held by frame 116 supported on the cart but which in turn are guided by a pair of guides 118 which are not parallel to the tracks 112 but positioned at an angle thereto at approximately 0° to 1°, as illustrated in FIG. 11*a* and FIG. 13. As the cart 110 moves forward in the operational sequence, the panel 106 is caused to shift in a lateral direction dictated by the guides 118 so that each set of perforations are offset in relation to the previous set and therefore establish a pattern which is non-parallel with the small ends of the panels, as can be seen in the panels which emerge from the operation at FIG. 11*c*.

This arrangement or pattern of perforations provides that the connectors will be oriented at a slight incline to the horizontal and therefore when adjacent panels or form sections are juxtaposed, adjacent reinforcing rods, which have to be overlapped where they meet to provide sufficient tensional strength, will not occupy the same space and therefore will not prevent the proper alignment of the forms and the reinforcing bars. In other words, the left hand end of one set of connectors will be offset vertically with respect to the right hand end of the next adjacent connectors and any reinforcing rods positioned thereon will likewise be offset to allow them to be overlapped longitudinally and spaced apart vertically.

FIG. 12 is an end elevation view of the perforating apparatus shown schematically in FIGS. 11*a*–11*c*.

As seen in FIG. 12 a perforator beam 114 is mounted at either end on columns 122 which allow the beam to be moved vertically downward towards the polystyrene panel 106 during the piercing operation and upward to disengage the panel and allow the panel to move one station forward to the next position in preparation for creating the next set of perforations.

The panel 106 is moved forward in a sequence of steps by means of the carriage or cart 110 which is also shown schematically in FIGS. 11*a*–11*c*. The cart 110 rides on tracks 112 supported by columns 115 and the movement of this carriage activated by the computerized control mechanism shown schematically as 117 determines the spacing by which each column of perforations is located on the panel by moving the carriage ahead a predetermined distance prior to each perforating operation.

The apparatus of FIG. 12 is illustrated in plan view in FIG. 13 and shows how the frame 116, which determines the lateral position of the panels, is guided along a pair of tracks 118 which are offset and angled to the cart tracks by about 0°–1° as aforementioned. Therefore, at each station the panel and frame are moved laterally aided by the wheels 126, so that each set of perforation is offset slightly from the previous column.

Thus, under the direction of the computerized panel 117, the panel is moved ahead to the first position of perforations and the beam 114 is lowered until the probes 120 penetrate through the polystyrene to create the pattern of perforations previously referred in relation to FIGS. 11*a*–11*c* and FIGS. 1 and 2.

Once the column or row of perforations is created, the beam 114 is raised and the panel is moved forward to the next location and the perforating process is repeated to form the next column.

The probes 120 located on the beam 114 are shown in greater detail in FIG. 14 where the probe 120 is a steel tube of a predetermined diameter is hollow and provided with an electrical connection 140 which provides electrical energy to a resistance wire 142 whereby the probe is heated to a desirable temperature sufficient to melt the polystyrene of the panel 106. The probe is filled with an electrically insulating material which isolates the wire 142 from the tubular body of the probe 120.

As the beam 114 is lowered the probe 120 is hot enough to melt the polystyrene and create a well forming perforation 20. The temperature of the probe, the rate at which it penetrates into the polystyrene, and the rate at which it is withdrawn can be adjusted to effect a perforation of a given diameter in relation to the diameter of the probe and experience has determined that this diameter can be adjusted and determined with reasonably accurate precision so as to accept with a reasonable degree of tolerance the threaded ends of the transverse rods 24 referred to previously.

FIG. 13 also illustrates in plan view the beam 114 with the perforating probes 120 mounted along it. It can be seen in this view these probes are not aligned but arranged so that each probe is offset in the direction of travel relative to the next adjacent probe. This means that every second perforation in a column will be offset horizontally or longitudinally (in relation to an upright form as illustrated in FIG. 1), and thus each alternate set of connectors will have transverse rods offset from the one above or the one below, as illustrated in FIG. 6, thus providing a confinement which will position and hold vertically oriented reinforcing bars.

Upon heating with current, the walls of steel tube of the perforating pin 120 is heated and create the thermal field. Upon reaching the temperature of the thermal field equal to 180–250 C (depending on quality of polystyrene) at the border with the surface of polystyrene panel 106, melting begins and continues during movement of the pin 120 from one surface of panel 106 to another. With this, there is no contact between pin 120 and opening 20. Movement speed is usually 3–60 mm/sec. during penetration.

FIGS. 15, 16 and 17 illustrate a means and method for assembling a prefabricated section of form such as illustrated in FIG. 1.

In FIG. 15, which is a front view of a frame 132 for prefabrication of 3D construction form, the stand 130 supports a frame 132 vertically on which panels such as 108 and 108*a* 106 are mounted, securely held, and accurately positioned. On the frame 132 are mounted along the upper and lower horizontal edges a series of forks 134 aligned with and corresponding to each of the rows of perforations in the panel 106. These forks may be formed by two parallel pieces of angle iron to have a central opening 136 between them which allows the transverse rods 24 of a connector to be inserted in a manner which will align ends of the transverse rods provided for connection with fasteners precisely with the perforations 20 or 22 of the panels 8 or 8*a*. Once the connectors are positioned in the perforations of the panels, they may be secured by means of the fasteners 32 previously described which may be installed from the opposite side of the panel manually with the appropriate hand tool, or by means of a power tool driver similar to an electric screwdriver or a pneumatic power wrench.

It can be seen in FIG. 15 that the frame is designed to accommodate a panel larger then the standard size so as to provide a form of increased dimension similar to that illustrated in FIG. 4. In fact the illustration in FIG. 15 shows combined panels with 18 connectors by way of illustration.

As seen in the elevation view of FIG. 16, once the connectors have been positioned at the panels 108 (and 108*a*), the second panel 106 (and 106*a*) can be positioned by their openings 20 with details of on the opposite ends of the transverse rods 24 and affixed by means of the fasteners 30 in the same manner as the first panel. Arms 138 support panels 106 and 106*a* until fixation fasteners 30 to connectors 10.

Forks 134 are connected by a horizontal beam and provided with a mechanism to travel perpendicular to the long edge of the polystyrene panel at 136 so that the forks 134 can be moved a retracted position while the panel is inserted and then moved to the closed position holding the panel in precise location while the connectors 10 are positioned in the forks so that the ends of the transverse rods will engage the perforations as previously mentioned. Also, after insertion of fasteners 30 into panels 106 and 106*a*, several connectors 32 are inserted into openings 22 and fixed to connector 10 in order to turn 3D construction form over for better connection with fasteners.

FIG. 17 is a plan view of the frame in FIGS. 15 and 16 in which the transverse rods can be seen extending outward from the first panel 108 and the second panel 106 has been placed on the opposite ends of the transverse rods 24.

Thus, the assembly of a prefabricated set of 3D construction forms is facilitated by the stand 130 and frame 132 which allows for the accurate placement of the panels, the easy installation of the transverse rods of the connectors, and the placement of the second panel on the opposite ends of the transverse rods, all of which can be performed by a worker at a height convenient to a standing position.

By means of this frame the connectors can be accurately placed so that the panels can be inserted and fastened relatively quickly with a minimum amount of manual handling and adjustment of the various pieces which is a sometimes difficult operation considering that there are some many rods which need to be placed accurately in perforations of the panels.

It will, of course, be realized that numerous modifications and variations of the illustrated embodiments may be employed without departing from the inventive concept herein.

What is claimed is:

1. A method of fabricating 3D construction forms comprising the steps of:

preparing a first panel with a predetermined pattern of perforations through a thickness of said first panel;

preparing a second panel with a corresponding predetermined pattern of perforations through a thickness of said second panel;

assembling said first and second panels in a fixed parallel spaced apart relationship by connecting said panels together with connectors designed to engage said perforations of respective panels, and wherein said panels are assembled by the steps comprising:

i) placing a first panel in a fixed position held by a frame;

ii) placing a plurality of connectors in a clamping mechanism associated with said frame so that said connectors are aligned with and engaged to the perforations of said first panel;

iii) placing a second panel to be mounted on said connectors by aligning and engaging said second panel perforations to the other ends of said transverse rods;

iv) securing said panels in said parallel spaced apart relationship by attaching fasteners to said transverse rods; and v) wherein said first panel is a standard sized panel, and wherein said method includes the step of extending the dimension of said form by adding at least a portion of a standard panel to said standard sized panel in edge to edge relationship at a joint so as to form a construction form of non-standard size dimensions, and fastening said portion of said standard panel to said first panel by a plate extending between adjacent connectors on either side of said edge to edge joint.

2. A method as claimed in claim 1 in which said panels are foamed polystyrene.

3. A method as claimed in claim 1 in which said connectors comprise transverse rods extending between the perforations of said first and second panels and tie rods extending between and fixed to said transverse rods to maintain spacing between said transverse rods corresponding to the pattern of perforations in said first and second panels.

4. A method of fabricating 3D construction forms as claimed in claim 3 to form a corner comprising the steps of:

cutting the tie rods of said connectors to form two pieces of connectors;

arranging one piece of said connector in angular orientation to the remainder of said connector;

placing reinforcing bars, bent at angles corresponding to said angular orientations, across the intermediate portion of said transverse rods and fastening said fastening said connectors thereto;

cutting a first panel to fit the dimension of the first outer panel of said corner and attaching said transverse rods to the perforation of said cut panel;

cutting a second panel to form the dimensions of the second outer panel of said corner and attaching same to the ends of the transverse rods to form a second outer panel of said corner;

cutting a first inner piece of said first panel to form the first inner portion of said corner and attaching same to the inner ends of said transverse rods;

cutting a second inner panel of said second panel to form the second inner surface of said corner and attaching same to the inner ends of said transverse rods.

5. A method as claimed in claim 4 including welding a portion of transverse rod in the intermediate part of the endmost transverse rod at a spacing equal to the spacing between perforations in said panel.

6. A method as claimed in claim 5 including the steps of inserting vertical reinforcing bars adjacent to the said reinforcing bars and positioned between the transverse rods which are offset in relation to the next adjacent transverse rods.

7. A method of fabricating a 3D construction form comprising the steps of:

a) providing a panel with a thickness, said panel having a plurality of transverse axially oriented perforations through said thickness and being arranged in a pre-determined pattern, said panel being oriented in a generally longitudinal orientation;

b) holding a plurality of connectors in a generally fixed transverse orientation, said connectors having an end portion that is generally axially aligned with said axial orientation of said perforations, said plurality of connectors comprises a plurality of generally transverse rods;

c) moving one or both of said panel and said plurality of transverse connectors towards the other or each other such that an end portion of each of said connectors is received axially into one said plurality of perforations;

d) affixing a fastener proximate said end portion of each of said connectors to fix each of said connectors to said panel; and e) tie rods oriented generally longitudinally and extending between and fixed to at least first and second transverse rods of said plurality of transverse rods to maintain spacing between said first and second transverse rods corresponding to the pattern of perforations in said panel, and wherein said gripping mechanism holds said first and second transverse rods.

8. A method a claimed in claim 7 wherein said panel has an inner surface which is generally planar and wherein an end portion of each of said connectors is received axially into one said plurality of perforations at said inner surface of said panel at substantially the same time.

9. A method as claimed in claim 7 wherein said panels are foamed polystyrene.

10. A method as claimed in claim 7 further comprising tie rods oriented generally longitudinally and extending between and fixed to at least first and second transverse rods of said plurality of transverse rods to maintain spacing between said first and second transverse rods corresponding to the pattern of perforations in said panel.

11. A method as claimed in claim 7, further comprising a gripping mechanism for holding said plurality of connectors in said generally fixed transverse orientation.

12. A method as claimed in claim 7 further comprising:

a) providing a second panel with a thickness, said second panel having a second plurality of transverse axially oriented perforations through said thickness and being arranged in a second pre-determined pattern, said second panel being oriented in a generally longitudinal orientation;

b) moving one or both of said second panel and said plurality of transverse connectors towards the other or each other such that a second end portion of each of said connectors, opposite to said first end portion, is received axially into one said second plurality of perforations;

c) affixing a fastener proximate said second end portion of each of said connectors to fix each of said connectors to said second panel.

13. A method a claimed in claim 12 wherein said second panel has an inner surface which is generally planar and wherein a second opposite end portion of each of said connectors is received axially into one said plurality of perforations at said inner surface of said second panel at substantially the same time.

14. A method of fabricating a 3D construction form comprising the steps of:

a) providing a first panel with a thickness, said first panel having a plurality of transverse axially oriented perforations through said thickness and being arranged in a pre-determined pattern, said panel being oriented in a generally longitudinal orientation and having a length of a first distance;

b) holding a plurality of connectors in a generally fixed transverse orientation, each of said plurality of connectors having an end portion that is generally axially aligned with said axial orientation of said perforations, said plurality of connectors extending longitudinally a second distance that is greater than said first distance;

c) moving one or both of said first panel and a first set of connectors of said plurality of transverse connectors towards the other or each other such that an end portion of each of said first set of connectors is received axially into one said plurality of perforations of said first panel;

d) affixing a fastener proximate said end portion of each of said first set of connectors to fix each of said first set of connectors to said first panel;

e) providing a second panel with a thickness, said second panel having a second plurality of transverse axially oriented perforations through said thickness and being arranged in a pre-determined pattern, said second panel being oriented in a generally longitudinal orientation and generally in longitudinal alignment with said first panel, said second panel having a length of a third distance;

f) moving one or both of said second panel and a second set of connectors of said plurality of connectors towards the other or each other such that an end portion of each of said second set of connectors is received axially into one said plurality of perforations of said second panel; and g) affixing a fastener proximate said end portion of each of said second set of connectors to fix each of said second set of connectors to said second panel.

15. A method a claimed in claim 14 wherein said first and second panels each has an inner surface which is generally planar and wherein an end portion of each of said first set of connectors is received axially into one said plurality of perforations at said inner surface of said first panel at substantially the same time, and wherein an end portion of each of said second set of connectors is received axially into one said plurality of perforations at said inner surface of said second panel at substantially the same time.

16. A method as claimed in claim 15 wherein the sum of said first distance and said third distance is substantially the same or greater than said second distance.

17. A method as claimed in claim 15 further comprising a) providing a third panel with a thickness, said third panel being positioned opposite and spaced from said first and second panels, and said third panel having a second plurality of transverse axially oriented perforations through said thickness and being arranged in a second pre-determined pattern, said third panel being oriented in a generally longitudinal orientation and having a length of a fourth distance;

b) moving one or both of said third panel and said plurality of transverse connectors towards the other or each other such that a second end portion of each of said connectors, opposite to said first end portion, is received axially at substantially the same time, into one said second plurality of perforations in said third panel;

c) affixing a fastener proximate said second end portion of each of said connectors to fix each of said connectors to said third panel.

18. A method as claimed in claim 17 wherein the sum of said first distance and said third distance is substantially the same as said fourth distance.

19. A method of fabricating a construction form comprising the steps of:

a) providing a first panel with a thickness, said first panel having a plurality of generally transverse axially oriented perforations through said thickness, said panel being oriented in a generally longitudinal orientation and said panel being made from a re-shapeable material;

b) providing a plurality of connectors, each of said connectors having an end portion that is generally axially aligned with said axial orientation of said perforations;

c) providing a stopper mechanism at an inner surface of said first panel;

d) providing a fastener for each of said plurality of connectors, each of said fasteners having a outer surface profile which is enlarges from an inner end toward a outer end;

e) engaging each said fastener with said end portion of each of said plurality of connectors through a perforation of said plurality of perforations to mount each of said connectors to said first panel;

wherein said fasteners are adapted to be tightened on said connector such that said panel is compressed between said stopper mechanism and at least a portion of said fastener, and said profile of said fastener deforms said panel proximate to block said perforations.

20. A method as claimed in claim 19 wherein said re-shapeable material is foamed polystyrene.

21. A method of fabricating a construction form comprising the steps of:

a) providing a first panel with a thickness, said first panel having at least generally transverse axially oriented perforations through said thickness, said panel being oriented in a generally longitudinal orientation and said panel being made from a suitable re-shapeable material;

b) providing a connectors that is generally axially aligned with said axial orientation of said perforation;

c) providing a stopper mechanism at an inner surface of said first panel;

d) providing a fastener at an end portion of said connector, said fastener having an outer surface profile which generally enlarges from an inner end toward a outer end;

e) engaging said fastener with said end portion of said connector through said perforation to mount said connector to said first panel;

wherein said fastener is adapted to be tightened on said connector such that said panel is compressed between said stopper mechanism and at least a portion of said fastener, and said profile of said fastener reshapes said panel to block said perforations.

22. A method as claimed in claim 21 wherein said re-shapeable material is foamed polystyrene.

23. A method as claimed in claim 21 wherein said stopper mechanism comprises a stopper device mounted proximate an end portion of said connector, said stopper device abutting at a first end an inner surface of said panel and at a second end an abutment member.

24. A method as claimed in claim 21 wherein said abutment member is a generally longitudinally oriented rod that is fixed transversely relative to said connector.

25. A method as claimed in claim 21 wherein said stopper mechanism comprises a stopper plate mounted proximate an end portion of said connector, said stopper device abutting at a first side an inner surface of said panel and at a second side an abutment member.

26. A method as claimed in claim 23 wherein said abutment member is a flange portion of said connector.

27. A method as claimed in claim 25 wherein said abutment member is a flange portion of said connector.

28. A method as claimed in claim 21 wherein said stopper mechanism is a generally longitudinally oriented rod that is fixed transversely relative to said connector.

29. A method as claimed in claim 21 wherein said profile has an end portion that is generally conical, said portion re-shaping said perforation when said panel is compressed, so as to block said perforation.

* * * * *